US012680326B2

(12) United States Patent
Andersen et al.

(10) Patent No.: US 12,680,326 B2
(45) Date of Patent: Jul. 14, 2026

(54) STEPS FOR A SPA

(71) Applicant: BULLFROG INTERNATIONAL, LC, Herriman, UT (US)

(72) Inventors: Michael Andersen, American Fork, UT (US); Mark McLane, Lehi, UT (US)

(73) Assignee: Bullfrog International, LC, Herriman, UT (US)

( * ) Notice: Subject to any disclaimer, the term of this patent is extended or adjusted under 35 U.S.C. 154(b) by 219 days.

(21) Appl. No.: 18/388,702

(22) Filed: Nov. 10, 2023

(65) Prior Publication Data

US 2025/0154785 A1 May 15, 2025

(51) Int. Cl.
*E04H 4/14* (2006.01)

(52) U.S. Cl.
CPC ..... *E04H 4/144* (2013.01)

(58) Field of Classification Search
CPC ..... E04H 4/144; E04F 11/035; E04F 11/104
See application file for complete search history.

(56) References Cited

U.S. PATENT DOCUMENTS

| | | | |
|---|---|---|---|
| D212,086 | S | 8/1968 | Gilman |
| 3,709,323 | A | 1/1973 | Trible |
| 3,755,981 | A | 9/1973 | West |
| 3,848,378 | A | 11/1974 | Witte |
| D270,567 | S | 9/1983 | Conlin |
| D277,409 | S | 1/1985 | Elsner et al. |
| 4,502,564 | A | 3/1985 | Kummerlin et al. |
| D280,551 | S | 9/1985 | Elsner et al. |
| D310,415 | S | 9/1990 | D'Innocente et al. |
| 5,094,505 | A | 3/1992 | Nichols |
| D372,985 | S | 8/1996 | Bourgault |
| 5,644,873 | A | 7/1997 | Bourgault |
| D383,261 | S | 9/1997 | Karsten et al. |
| D430,679 | S | 9/2000 | Rodgers |
| D449,117 | S | 10/2001 | Wilson |
| D465,032 | S | 10/2002 | Robbins et al. |
| D485,915 | S | 1/2004 | Robbins et al. |
| D502,553 | S | 3/2005 | Sorheim |
| D509,002 | S | 8/2005 | Sorheim |
| D512,518 | S | 12/2005 | St-Hilaire |
| D532,118 | S | 11/2006 | Reese |

(Continued)

OTHER PUBLICATIONS

European Patent Office "Extended European Search Report," for European Patent Application No. 24212034.3, Mar. 26, 2025.

(Continued)

*Primary Examiner* — Jennifer C Chiang
(74) *Attorney, Agent, or Firm* — Dentons Durham Jones Pinegar; Sarah W. Matthews; Lilly Godfrey

(57) ABSTRACT

This application relates generally to steps for a spa or another water containing vessel. In various aspects, steps for a spa may include a lower hollow frame, a first platform disposed over the lower hollow frame, and an upper hollow frame disposed over a back portion of the first platform. The steps may also include a second platform disposed over the upper hollow frame. Each of the lower hollow frame and the upper hollow frame may be formed of a plurality of structural panels and a plurality of decorative panels. The plurality of decorative panels may match any decorative paneling of the spa, next to which the steps are arranged.

15 Claims, 37 Drawing Sheets

(56) References Cited

U.S. PATENT DOCUMENTS

| | | | | |
|---|---|---|---|---|
| 7,150,129 | B2 * | 12/2006 | Elder | E04H 4/144 4/488 |
| D550,374 | S | 9/2007 | Genova | |
| D597,327 | S | 8/2009 | Vample | |
| D597,684 | S | 8/2009 | Genova | |
| D698,306 | S | 1/2014 | Grovender et al. | |
| D746,606 | S | 1/2016 | Jaap | |
| D760,852 | S | 7/2016 | Appleton | |
| D825,942 | S | 8/2018 | Hunter et al. | |
| D831,364 | S | 10/2018 | Brown | |
| D885,092 | S | 5/2020 | Greenwood | |
| D946,292 | S | 3/2022 | Turner | |
| D963,891 | S | 9/2022 | Greer et al. | |
| D963,892 | S | 9/2022 | Greer et al. | |
| D964,600 | S | 9/2022 | Greer et al. | |
| D979,162 | S | 2/2023 | Wang | |
| D979,796 | S | 2/2023 | Carriere et al. | |
| D982,185 | S | 3/2023 | Cerilli | |
| D993,461 | S | 7/2023 | Rosati | |
| D998,985 | S | 9/2023 | Yang | |
| D1,022,488 | S | 4/2024 | Ozturk | |
| D1,032,040 | S | 6/2024 | Robles | |
| D1,063,417 | S | 2/2025 | Yang | |
| D1,066,932 | S | 3/2025 | Hu | |
| D1,071,578 | S | 4/2025 | Dong et al. | |
| D1,071,629 | S | 4/2025 | Freundlich et al. | |
| D1,088,593 | S | 8/2025 | Zhang | |
| D1,097,606 | S | 10/2025 | Xiao | |
| 2004/0040785 | A1 | 3/2004 | Robinson et al. | |
| 2008/0029342 | A1 * | 2/2008 | Genova | E04F 11/00 182/151 |
| 2008/0257280 | A1 | 10/2008 | Jakubowski et al. | |
| 2011/0114419 | A1 | 5/2011 | Merey | |
| 2012/0167494 | A1 | 7/2012 | Brooks et al. | |
| 2024/0108144 | A1 | 4/2024 | Merey | |
| 2025/0154785 | A1 | 5/2025 | Andersen et al. | |

OTHER PUBLICATIONS

Bullfrog Hot Tub Steps, Published (Date Unknown), Retreived Sep. 10, 2025 [Online]. Retreived From Internet, https://www.mvspas.com/bullfrog-spas-hot-tub-steps/ (Year: 2025).

Canadian Intellectual Property Office, "Examiner's Report," for Canadian Patent Application No. 3,257,198, Feb. 6, 2026.

* cited by examiner

STEPS FOR A SPA

TECHNICAL FIELD

This disclosure relates generally to steps for a spa or another water-containing vessel.

SUMMARY

Disclosed are systems, devices, and/or methods of use thereof regarding steps for a spa or another water-containing vessel. In various aspects, a set of steps for a spa includes a pair of side panels, where each side panel has (i) a vertical portion defining or including a first plurality of mortices, and (ii) a horizontal portion integral with the vertical portion and defining or including a second plurality of mortices. The steps may additionally include a lower front panel configured to engage with a front edge of the horizontal portion and an upper front panel configured to engage with a front edge of the vertical portion. The steps may further include at least one back panel configured to engage with a back edge of the vertical portion. Still further, the steps may include a lower step platform connectable to the horizontal portion and the lower front panel and an upper step platform connectable to the vertical portion and the upper front panel.

In various aspects, a set of steps for a spa includes a lower step having a step platform and a front panel, and an upper step having a step platform and a front panel. The steps may also include a first side panel connectable to a first side of the lower step and a first side of the upper step. The steps may further include a second side panel connectable to a second side of the lower step and a second side of the upper step. The second side of the lower step and the upper step may be opposite the first side of the lower step and the upper step. The steps may additionally include a back panel connectable to a back edge of the step platform of the upper step. The step platform of the lower step may be interchangeable with the step platform of the upper step.

In various aspects, a method of forming steps for a spa may include blow-molding a first side panel, the first side panel defining a first plurality of mortices, and blow-molding a second side panel, the second side panel defining a second plurality of mortices. The method may also include blow-molding at least one front panel, the at least one front panel having a first tenon extending from a first end and a second tenon extending from a second end opposite the first end. A decorative panel matching other decorative paneling of the spa may be attachable to the at least one front panel. The method may further include slidably connecting the at least one front panel with the first side panel and slidably connecting the at least one front panel with the second side panel. The method may include attaching at least one step platform to the first side panel, the second side panel, and the at least one front panel.

In various aspects, a set of steps for a spa includes a lower step having a base frame, a step platform, and a storage platform defining an access window. The base frame may include a plurality of structural panels for slidably receiving a plurality of decorative panels, where the decorative panels match decorative panels of the spa. The steps may also include an upper step positionable over the storage platform of the lower step. The upper step may have a base frame and a step platform, where the base frame of the upper step may include a plurality of structural panels for slidably receiving a plurality of decorative panels. The plurality of decorative panels of the upper step match the plurality of decorative panels of the lower step and the decorative panels of the spa.

In various aspects, steps for a spa may include a lower frame having a front structural panel, a back structural panel opposite the front structural panel, a first side structural panel, and a second side structural panel opposite the first side structural panel. Each structural panel of the lower frame may have a body with a mortice at a first end and a tenon at a second end opposite the first end, and a face plate extending from the body. The face plate may be for slidably receiving a decorative panel. The steps may also include a first step platform connectable to the front structural panel, a portion of the first side structural panel, and a portion of the second side structural panel. The steps may further include a storage platform abutting the step platform and connectable to the back structural panel, a portion of the first side structural panel, and a portion of the second side structural panel. Still further, the steps may include an upper frame positionable over the storage platform and a second step platform connectable to the upper frame.

In various aspects, a method of assembling steps for a spa may (i) include sliding a first decorative panel onto rails of a front structural panel, with the first decorative panel matching other decorative paneling of the spa, and (ii) slidably engaging a tenon of the front structural panel with a mortice of a first side structural panel, such that the first decorative panel cannot be removed from the front structural panel. The method may also include (iii) sliding a second decorative panel onto rails of the first side structural panel, with the second decorative panel matching the first decorative panel, and (iv) slidably engaging a tenon of the first side structural panel with a mortice of a back structural panel, such that the second decorative panel cannot be removed from the first side structural panel. The method may further include (v) sliding a third decorative panel onto rails of the back structural panel, with the third decorative panel matching the first and second decorative panels, and (vi) slidably engaging a tenon of the back structural panel with a mortice of a second side structural panel, such that the third decorative panel cannot be removed from the back structural panel. Still further, the method may include (vii) sliding a fourth decorative panel onto rails of the second side structural panel, with the fourth decorative panel matching the first, second, and third decorative panels, and (viii) slidably engaging a tenon of the second side structural panel with a mortice of the front structural panel, such that the fourth decorative panel cannot be removed from the second side structural panel. The front structural panel, the first side structural panel, the back structural panel, and the second side structural panel form a lower hollow frame.

In various aspects, a method of assembling steps for a spa may (i) include sliding a first decorative panel onto rails of a front structural panel, with the first decorative panel matching other decorative paneling of the spa, and (ii) slidably engaging a tenon of the front structural panel with a mortice of a first side structural panel, such that the first decorative panel cannot be removed from the front structural panel. The method may also include (iii) sliding a second decorative panel onto rails of the first side structural panel, with the second decorative panel matching the first decorative panel, and (iv) slidably engaging a tenon of the first side structural panel with a mortice of a back structural panel, such that the second decorative panel cannot be removed from the first side structural panel. The method may further include (v) sliding a third decorative panel onto rails of the back structural panel, with the third decorative panel matching the first and second decorative panels, and (vi) slidably engaging a tenon of the back structural panel with a mortice of a second side structural panel, such that the third decorative panel cannot be removed from the back structural panel. Still further, the method may include (vii) sliding a fourth decorative panel onto rails of the second side structural panel, with the fourth decorative panel matching the first, second, and third decorative panels, and (viii) slidably engaging a tenon of the second side structural panel with a mortice of the front structural panel, such that the fourth decorative panel cannot be removed from the second side structural panel. The front structural panel, the first side structural panel, the back structural panel, and the second side structural panel form a lower hollow frame. The method may further include attaching a lower step platform to the lower hollow frame to form a lower step, positioning an upper frame over the lower step platform, and flanking the lower hollow frame and the upper frame with a pair of containers.

In various aspects, steps for a spa may include a lower hollow frame, a first platform disposed over the lower hollow frame, and an upper hollow frame disposed over a back portion of the first platform. The steps may also include a second platform disposed over the upper hollow frame, a first container arranged on a first side of the lower hollow frame and a first side of the upper hollow frame, and a second container arranged on a second side opposite the first side of the lower hollow frame and a second side opposite the first side of the upper hollow frame.

In various aspects, a connection mechanism includes a body, a first projection at a first end of the body, and a second projection at a second end of the body, where the first projection is for engaging an underside of a spa and the second projection is for engaging an underside of steps for the spa.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
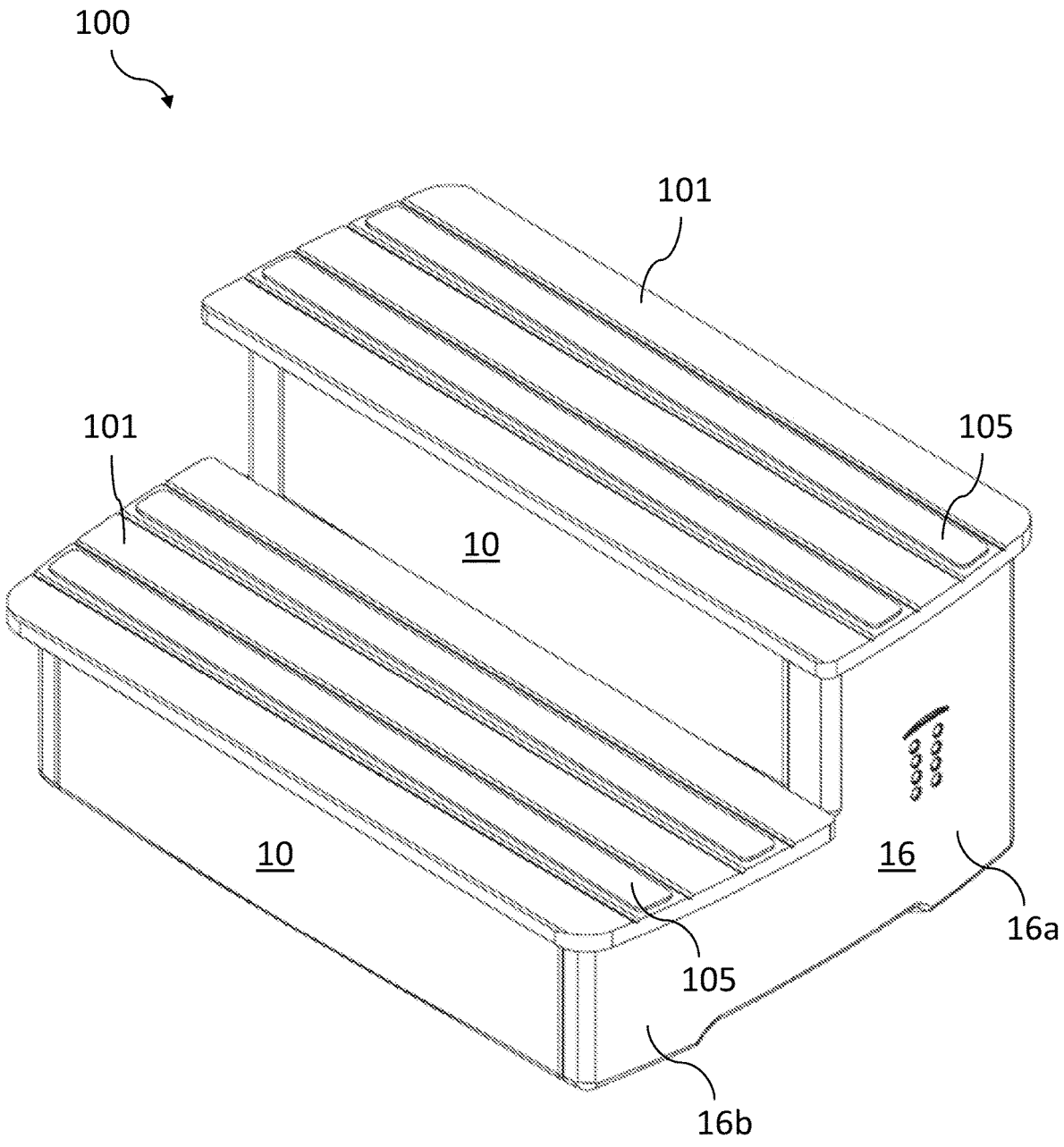
FIG. 1 illustrates one embodiment of steps for a spa.
Figure 2:
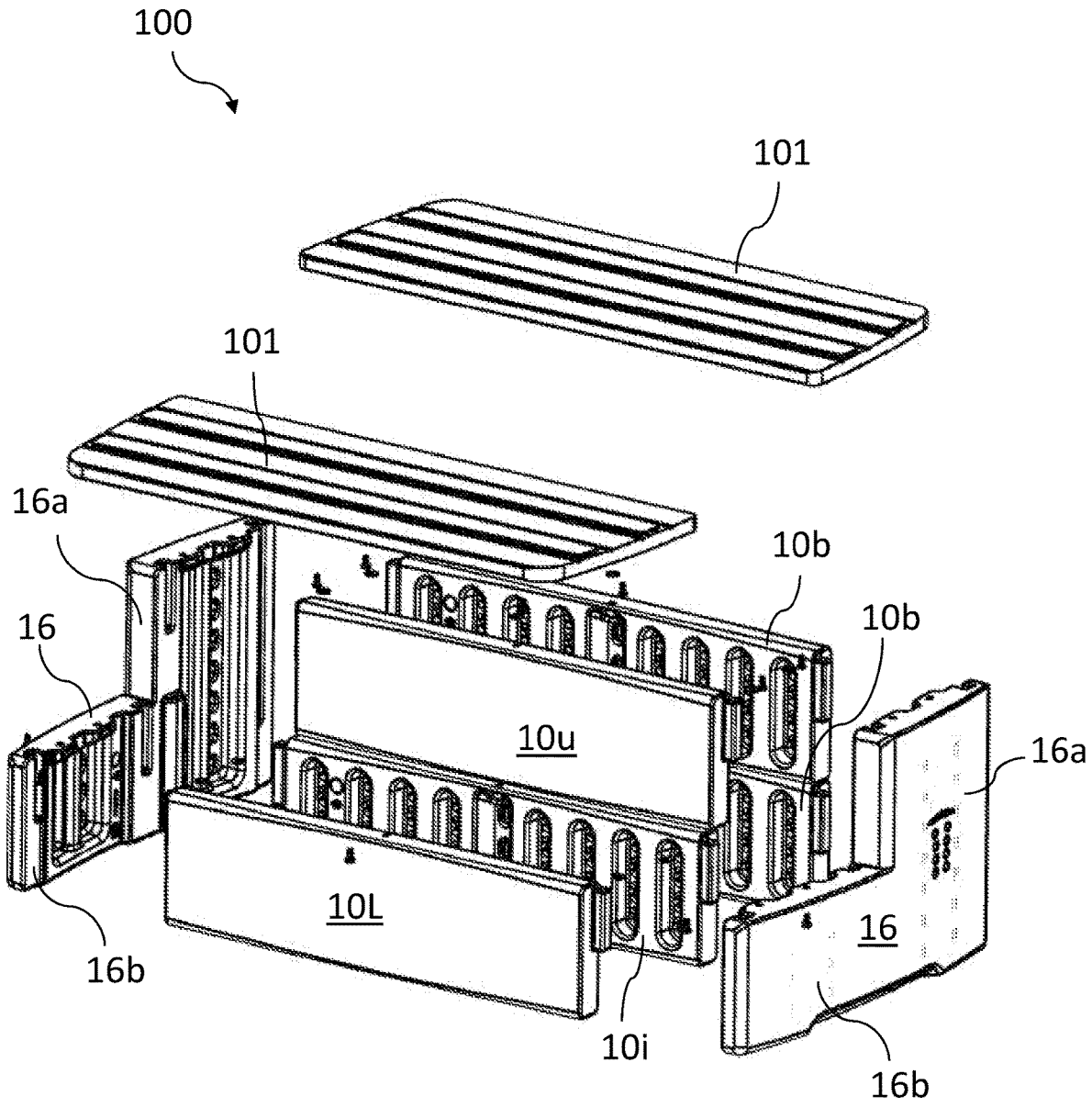
FIG. 2 illustrates an exploded view of the steps of FIG. 1.
Figure 3:
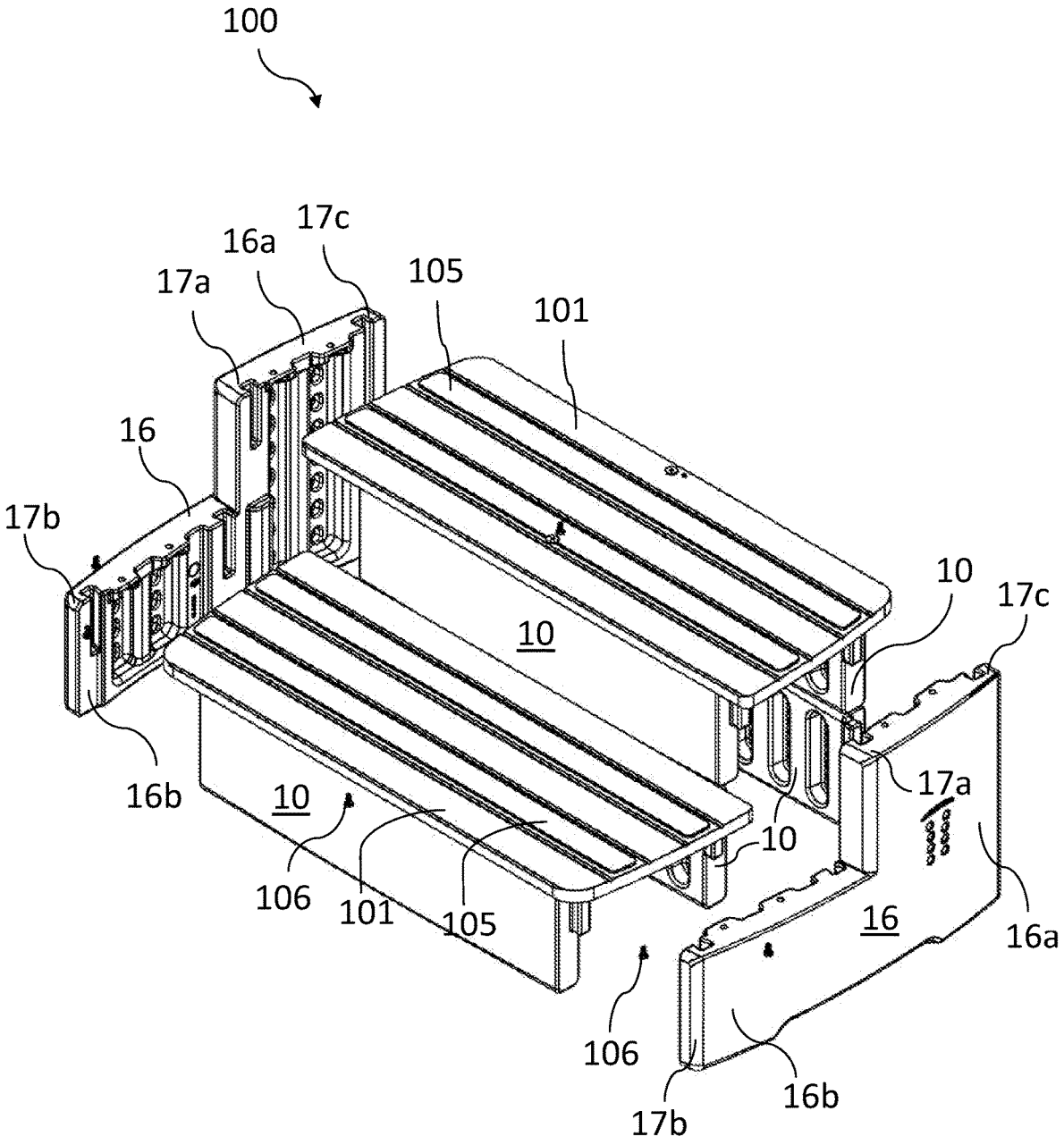
FIG. 3 illustrates a partially exploded view of the steps of FIG. 1.

FIGS. 1-3 illustrate one embodiment of steps 100 for a spa or other water containing vessel. As illustrated, the steps 100 include at least two panels 10 (e.g., an upper panel 10*u* and a lower panel 10L), side panels 16, and step platforms 101. Referring to FIG. 2, the panels 10 include an upper panel 10*u*, a lower panel 10L, back panels 10*b*, and an interior panel 10*i*. Each of the panels 10 may be identical or substantially identical to each other and may be interchangeable with each other. The upper panel 10*u* may be arranged over the interior panel 10*i*, and an upper back panel 10*b* may be arranged over a lower back panel 10*b*. In some embodiments, the back panels 10*b* may be one single panel. The step platforms 101 may be arranged over top edges of the panels 10 and may be interchangeable with each other.

The side panels 16 may be mirror images of each other and may flank the front panels or panels 10. For example, the side panels 16 may slidably receive ends of each of the front panels 10. The side panels 16 may have a vertical portion or upper portion 16*a* and a horizontal portion or lower portion 16*b*. As illustrated, the vertical portion 16*a* and the horizontal portion 16*b* are integral with each other. In other embodiments, the vertical portion 16*a* may be connectable to the horizontal portion to form the side panel 16. As discussed more herein, the lower panel 10L may slidably engage with a front edge 17*b* of the lower portion 16*b*, and the upper panel 10*u* may slidably engage with a front edge 17*a* of the upper portion 16*a*. The back panel(s) 10*b* may slidably engage with a back edge 17*c* of the upper portion 16*a*.

In some configurations, the panels 10 and the side panels 16 may be formed through a blow-molding process. For example, each of the panels 10 and the side panels 16 may be formed of a plastic and, through the blow-molding process, may have hollow interiors. This allows the step 100 to be light and easily maneuverable/positionable against a spa. Additionally, as each of the panels 10 are identical, the blow-molding process requires a single mold for each of the panels 10. In other configurations, blow-molding may be used for some parts of the steps 100, or other suitable methods may be used to form the steps.

The step platforms 101 may be interchangeable, such that the top step platform 101 may be used as the bottom step platform 101 and vice versa. The step platforms 101 simply need to be rotated 180° to be in a proper orientation. The step platforms 101 may rest on top edges 13 of the panels 10 as well as resting on a top edge or surface of (i) the upper portion 16*a* (for the top step platform 101) and/or (ii) the lower portion 16*b* (for the lower step platform 101). Specifically, the top edge or surface of the upper and lower portions 16*a*, 16*b*, as well as the top edge 13 of the panels 10, may include one or more holes 107 (see FIG. 6A) to receive a fastener 106. The fastener 106 may be a screw, rod, etc. and may include a washer. In this way, the step platforms 101 can be fastened to the panels 10 and the side panels 16 to securely assemble the steps.

Figure 4A:
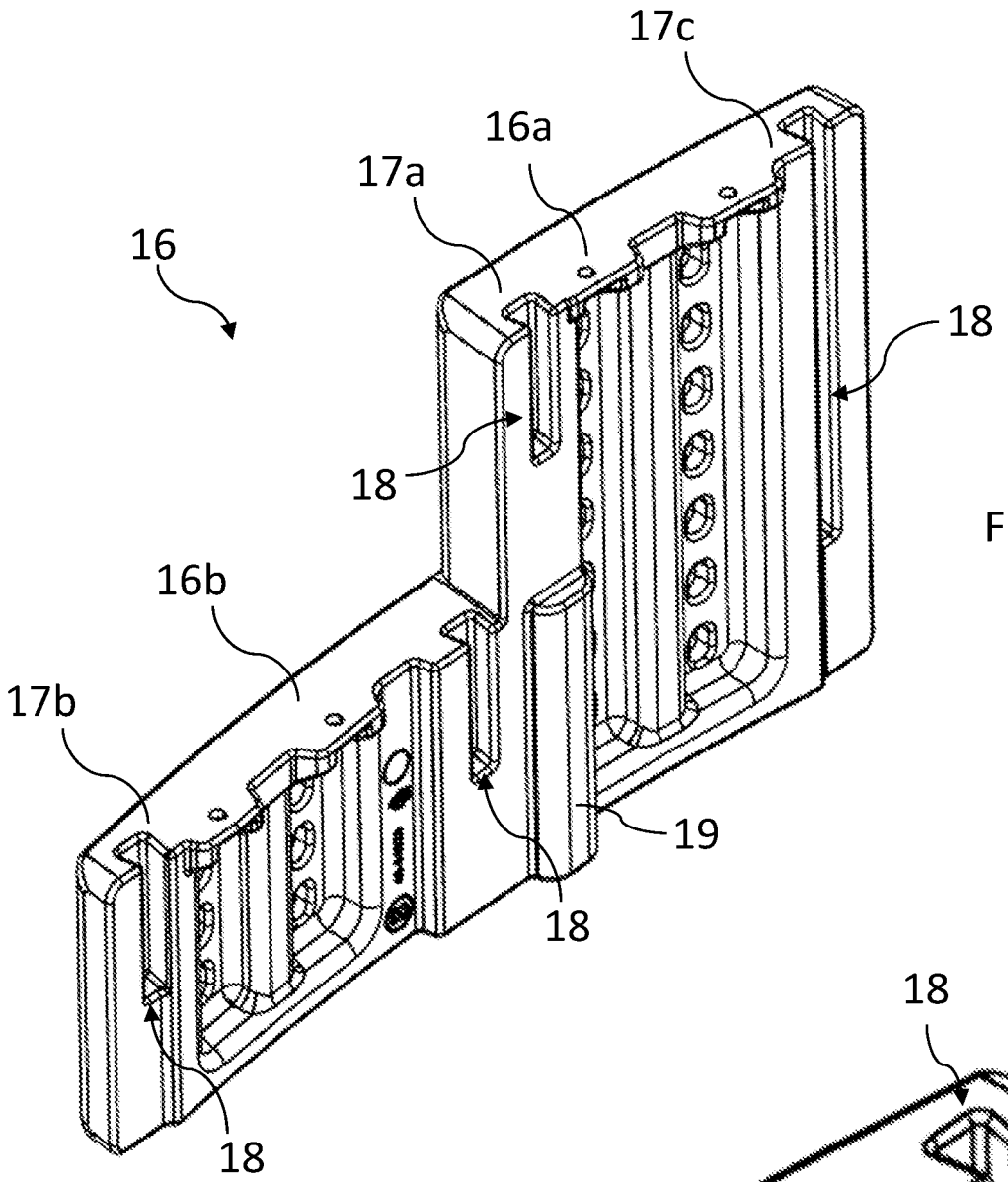
FIG. 4A illustrates a side panel of the steps of FIG. 1
Figure 4B:
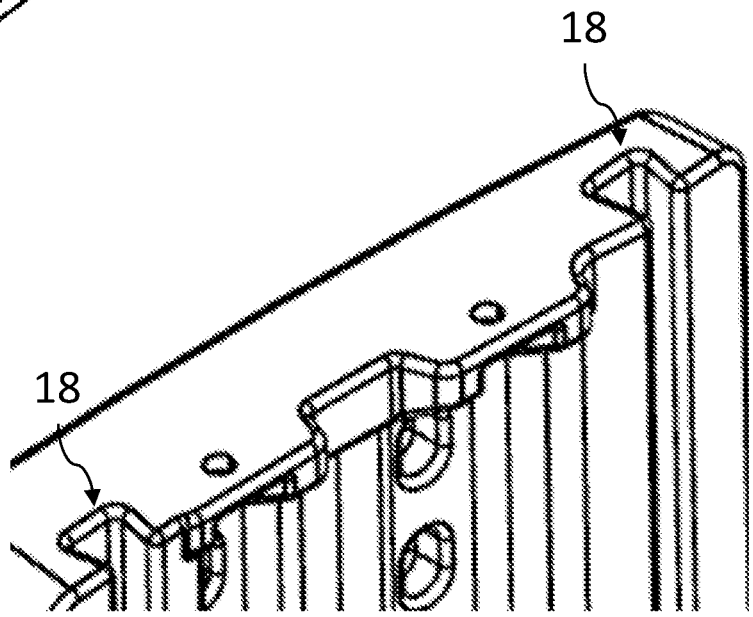
FIG. 4B illustrates a close-up view of the mortices defined within the side panel of FIG. 4A.

FIG. 4A illustrates a side panel 16 of the steps 100 of FIG. 1 and FIG. 4B illustrates a close-up view of the mortices 18, or slots, defined within the side panel 16 of FIG. 4A. Though only one (1) side panel 16 is illustrated, it is to be understood that the description applies to both side panels 16, as the side panels 16 are mirror images of each other in this configuration. In other configurations, the side panels may not be mirror images. An interior of the side panel 16 defines a plurality of mortices 18 to receive or slidably engage with tenons/projections of the panels 10 (see tenons 15 at each end of the panels 10 in FIGS. 5A-6B). The mortices 18 are defined where the panels 10 are intended to engage or mate with the side panels 16.

For example, a first mortice 18 is defined near or adjacent to the front edge 17*b* of the horizontal/lower portion 16*b*, a second mortice 18 is defined near or adjacent to the front edge 17*a* of the vertical/upper portion 16*a*, etc. The front edge 17*a* of the vertical/upper portion 16*a* may also correspond to a back edge of the horizontal portion 16*b* and a third mortice 18 may be defined near or adjacent to the front/back edge 17*a*. A fourth mortice 18 may be defined near or adjacent to the back edge 17*c* of the vertical portion 16*a*. Referring to FIG. 4B, the mortices 18 may be shaped such that they form a dovetail joint with the tenons 15 of the panels 10, when the front panels 10 are engaged with the side panels 16.

A size or length of the mortices 18 may correspond to (i) a size or length of the tenons 15 of the panels 10, and/or (ii) a number of panels 10 being received by the mortice 18. For example, the fourth mortice 18 near or adjacent to the back edge 17*c* of the vertical portion 16*a* may be twice as long as the first mortice 18 near or adjacent to the front edge 17*b* of the horizontal portion 16*b*. This is because the fourth mortice 18 is for engaging two (2) back panels 10*b*, so the length of the fourth mortice 18 needs to accommodate two tenons 15 stacked on top of each other.

The interior of the side panel 16 may also include a block 19. The block 19 may be for supporting the upper panel 10*u*. Specifically, a bottom edge 14 of the upper panel 10*u* (see FIG. 5A) may rest on or abut the block 19. The block 19 may be arranged vertically under the second mortice 18 near or adjacent to the front edge 17*a* of the vertical/upper portion 16*a*. Thus, when the tenon 15 of the upper panel 10*u* is received within the second mortice 18, the bottom edge 14 of the upper panel 10*u* may abut or rest on the block 19.

Figure 5A:
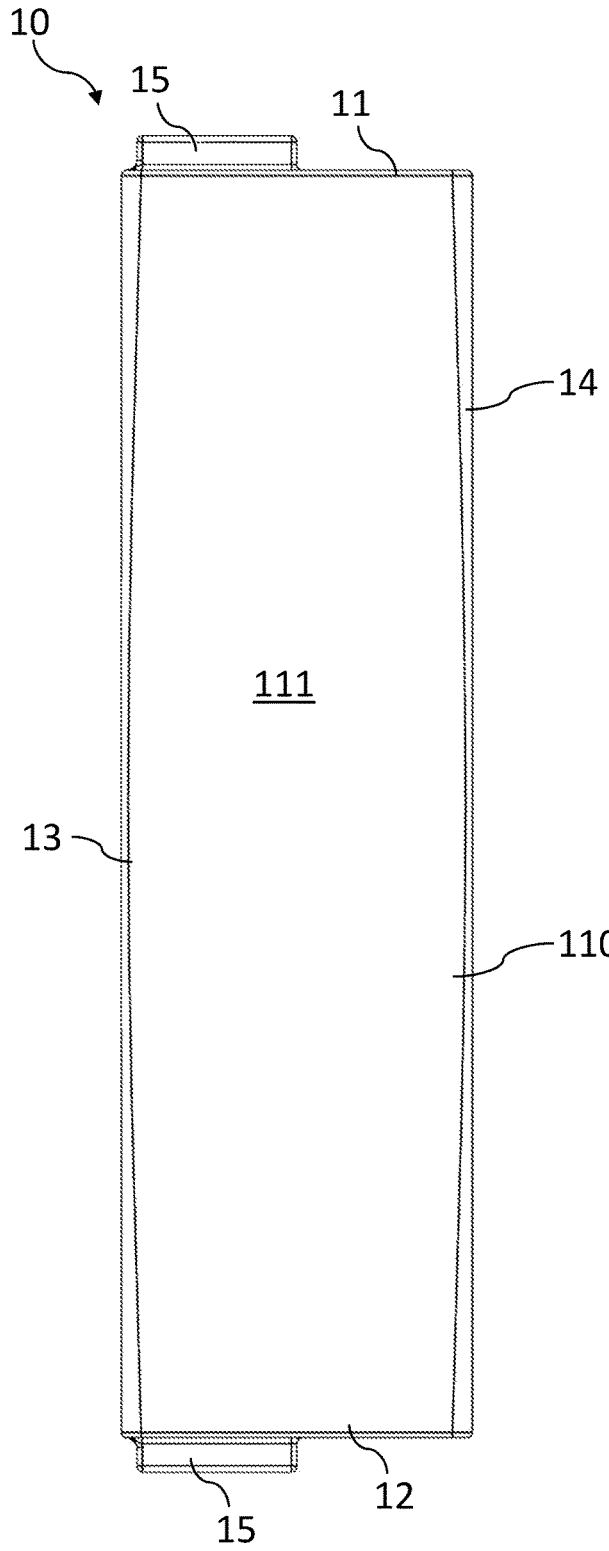
FIG. 5A illustrates a front view of a panel of the steps of FIG. 1
Figure 5B:
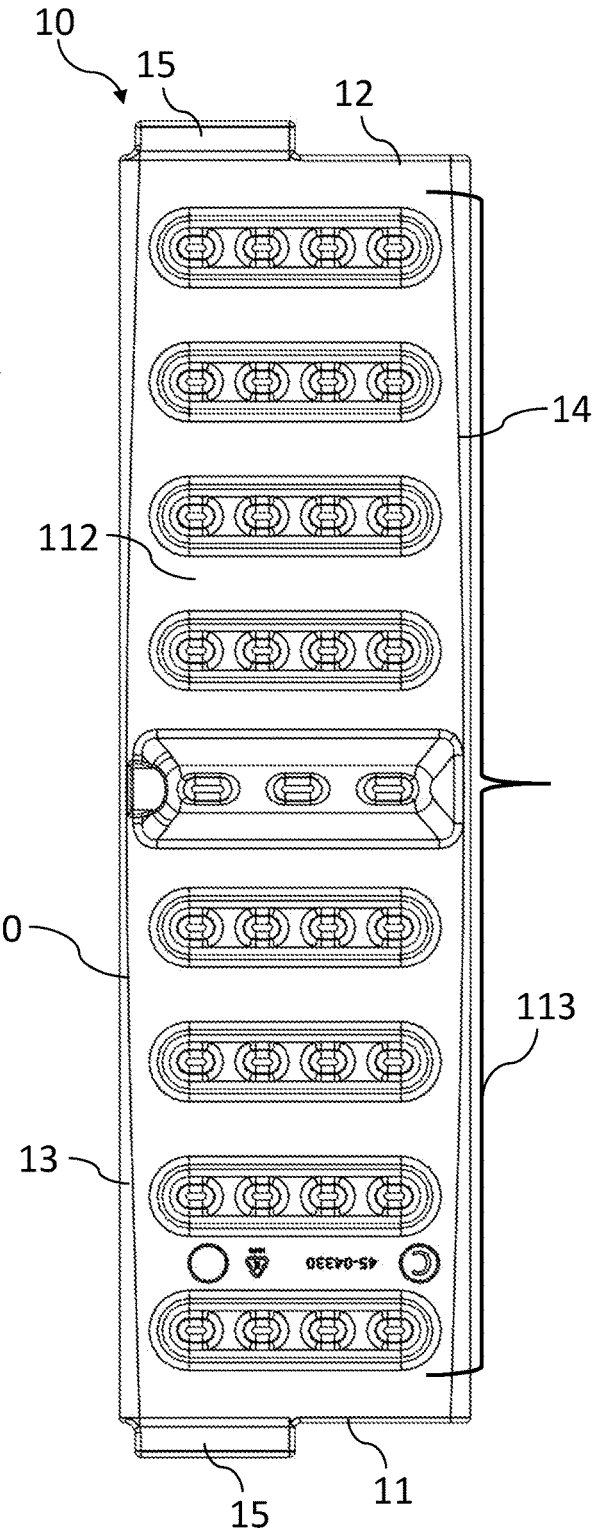
FIG. 5B illustrates a back view of the panel.
Figure 6A:
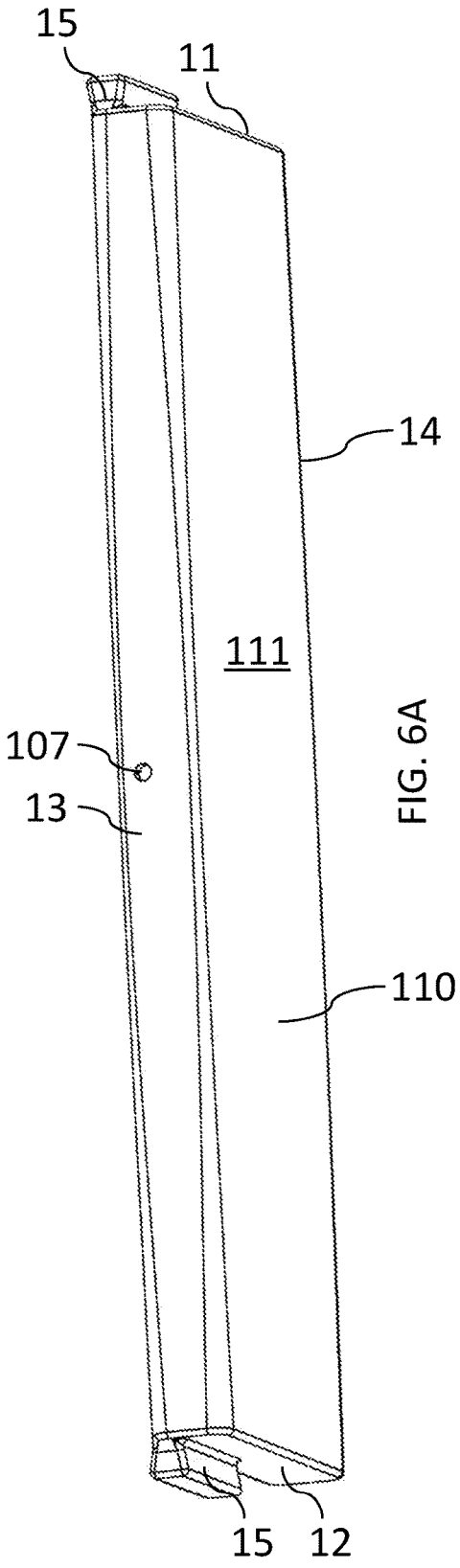
FIG. 6A illustrates a perspective view of the panel of FIGS. 5A-5B and FIG. 6B illustrates a close-up view of a tenon of the panel of FIGS. 5A-5B.
Figure 6B:
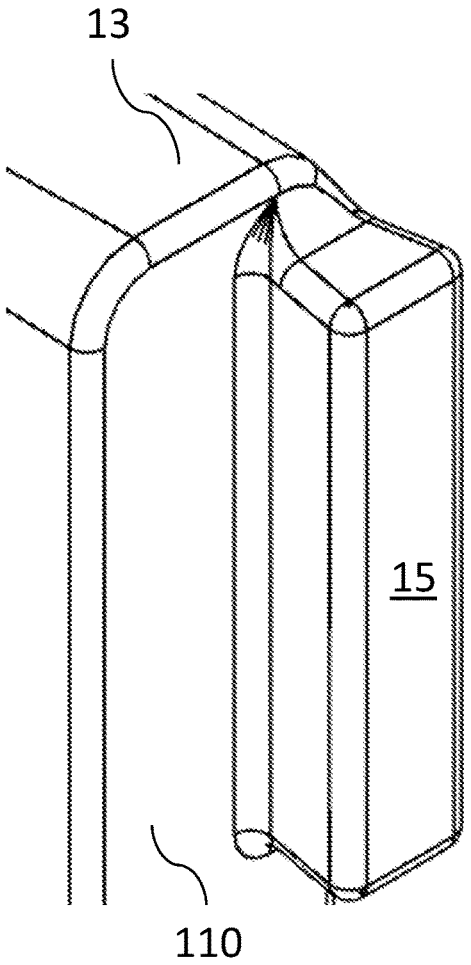

FIG. 5A illustrates a front view of a panel 10 of the steps 100 of FIG. 1, FIG. 5B illustrates a back view of the panel 10, FIG. 6A illustrates a perspective view of the panel 10, and FIG. 6B illustrates a close-up view of a tenon 15 of the panel 10. Each of the panels 10 include a body 110 with a top edge 13, a bottom edge 14 opposite the top edge 13, a first end 11, and a second end 12 opposite the first end 11. Extending from both the first and second ends 11, 12 may be a tenon 15. The tenon 15 is sized and shaped to slidably mate or slidably engage the mortices 18 defined by the side panels 16. For example, referring to FIG. 6B, the tenon 15 may extend from the body 110 of the panel 10 and may widen in the direction of extension. That is, where the tenon/projection 15 meets the body 110 may be narrower than where the extension of the tenon 15 ends. This shape may correspond to the shape of the mortices/slots 18 and may form a dovetail joint when the tenon 15 is received within the mortice 18 (see FIG. 4B).

The body 110 of each panel 10 has a front face 111 and a back face 112. Defined within the back face 112 may be one or more cavities or depressions 113. The depressions 113 may be a result of the manufacturing process (e.g., blow-molding) of the panels 10. Additionally, the depressions 113 may reduce the amount of material needed to manufacture the panels 10, as well as making the panels 10 lighter, thus savings costs in materials and shipping. The lighter panels 10 are also easier for a user to manipulate when assembling the steps 100.

Figure 7:
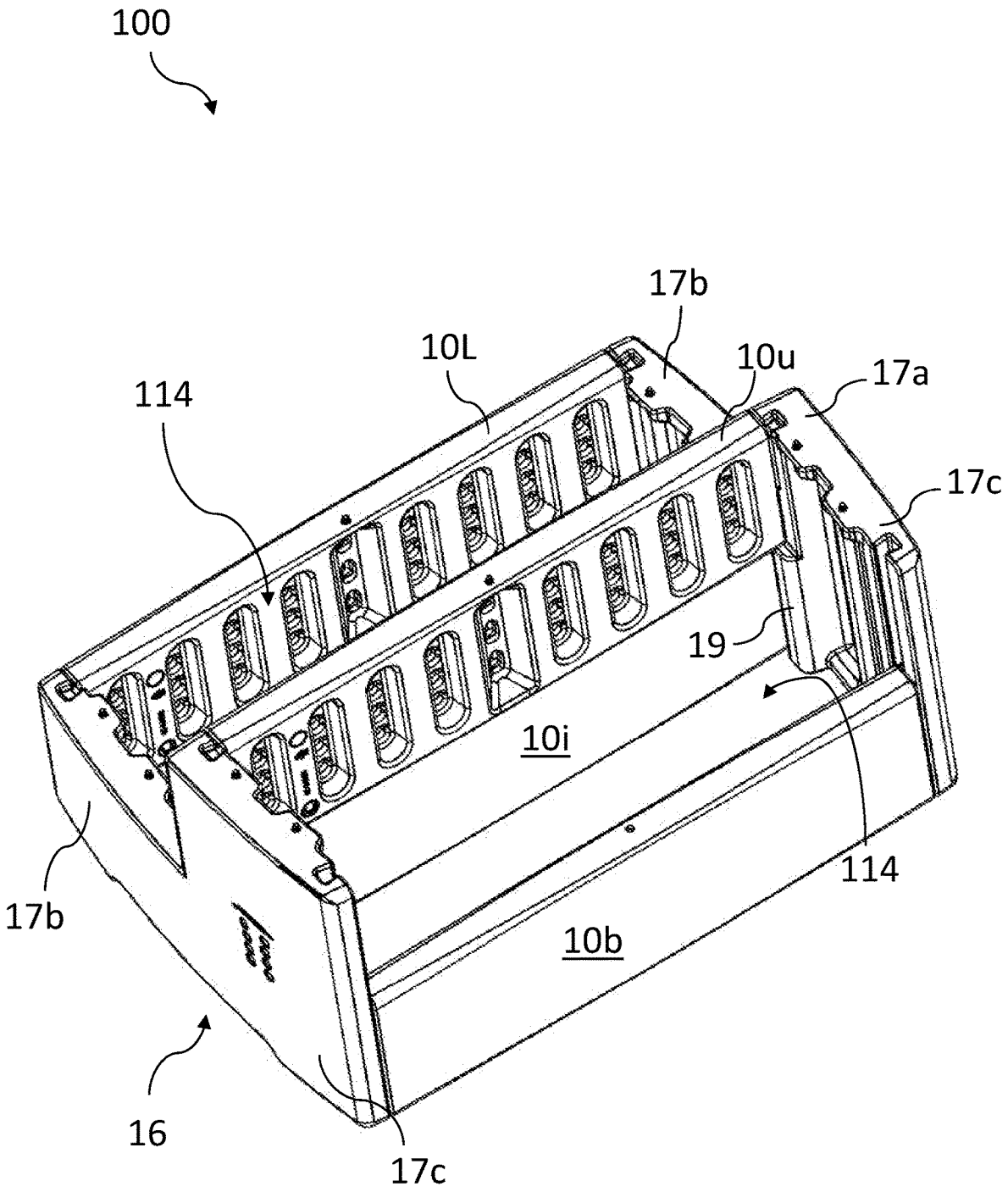
FIG. 7 illustrates a back perspective view of the steps of FIG. 1 with the step platforms and one back panel removed, such that the interior of the steps is visible.

FIG. 7 illustrates a back perspective view of the steps 100 of FIG. 1 with the step platforms 101 and one back panel 10*b* removed, such that the interior of the steps 100 is visible. As clearly illustrated, the tenons 15 of lower panel 10L engage the mortices 18 disposed near the front edge 17*b* of the horizontal/lower portion 16*b*. The tenons 15 of the upper panel 10*u* engage the mortices 18 disposed near the front edge 17*a* of the vertical/upper portion 16*a*. Additionally, the upper panel 10*u* can be seen arranged over the interior panel 10*i*, where the interior panel 10*i* engages mortices 18 disposed near the front edge 17*a* (and the back edge of the horizontal portion 16*b*) of the vertical/upper portion 16*a*. Further, the bottom edge 14 of the upper, front panel 10*u* can be seen resting on or abutting the block 19 of the side panels 16.

Defined between the lower panel 10L and the interior panel 10*i*, and between the interior panel 10*i* and the back panels 10*b*, are hollow spaces 114. In some embodiments, the hollow spaces 114 may be for storing spa accessories or chemicals. The hollow spaces 114 may simply make the steps 100 lighter and easier to maneuver for a user.

Figure 8:
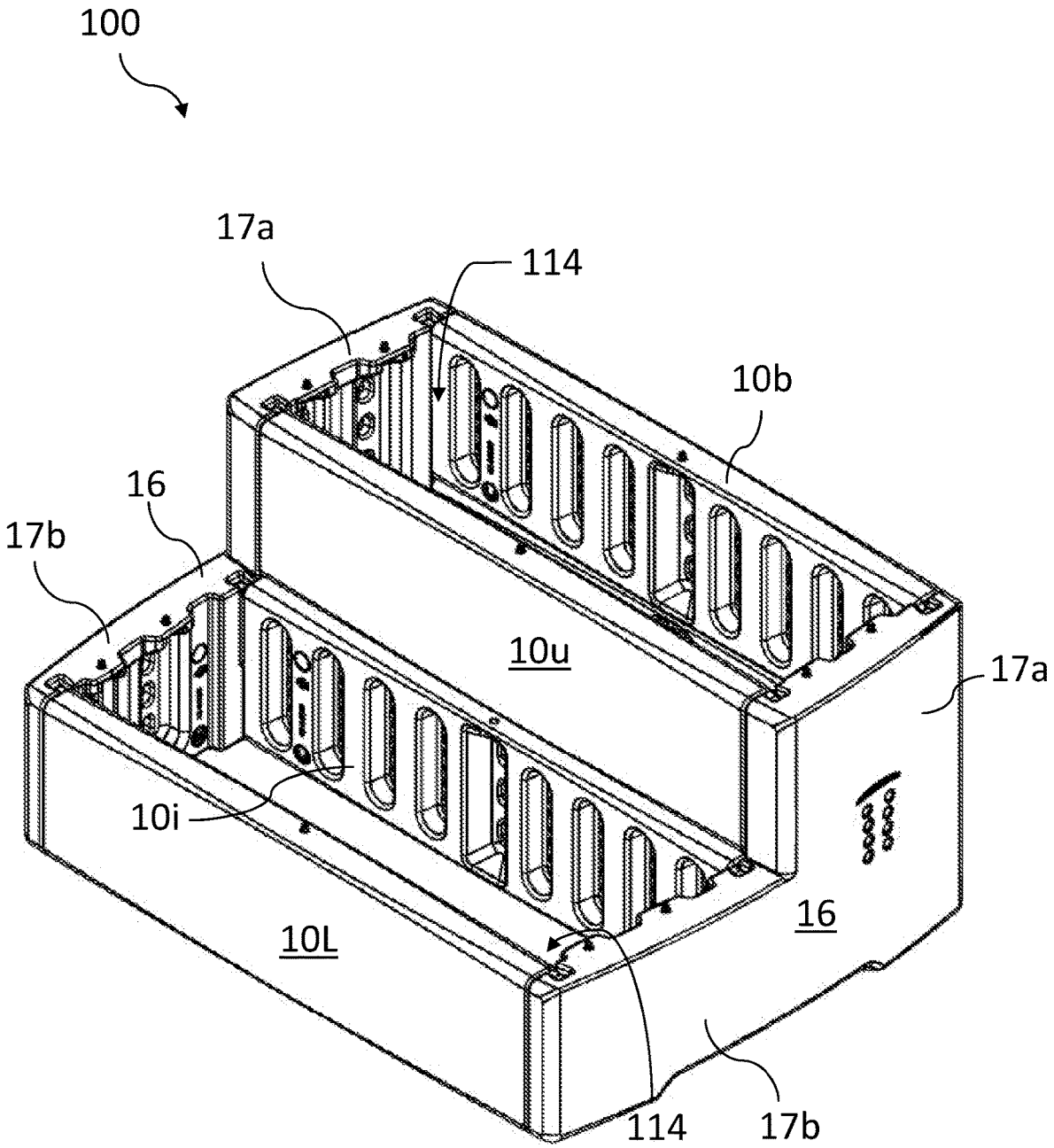
FIG. 8 illustrates a front perspective view of the steps of FIG. 1 with the step platforms removed, such that the interior of the steps is visible.

FIG. 8 illustrates a front perspective view of the steps 100 of FIG. 1 with the step platforms 101 removed, such that the interior of the steps is visible. As with the back view of FIG. 7, the tenons 15 of lower panel 10L engage the mortices 18 disposed near the front edge 17*b* of the horizontal/lower portion 16*b*. The tenons 15 of the upper panel 10*u* engage the mortices 18 disposed near the front edge 17*a* of the vertical/upper portion 16*a*. Additionally, the upper panel 10*u* can be seen arranged over the interior panel 10*i*, where the interior panel 10*i* engages mortices 18 disposed near the front edge 17*a* (and the back edge of the horizontal portion 16*b*) of the vertical portion 16*a*. The same hollow spaces 114 can be seen, defined between the lower panel 10L and the interior panel 10*i*, and between the interior panel 10*i* and the back panels 10*b*.

Figure 9:
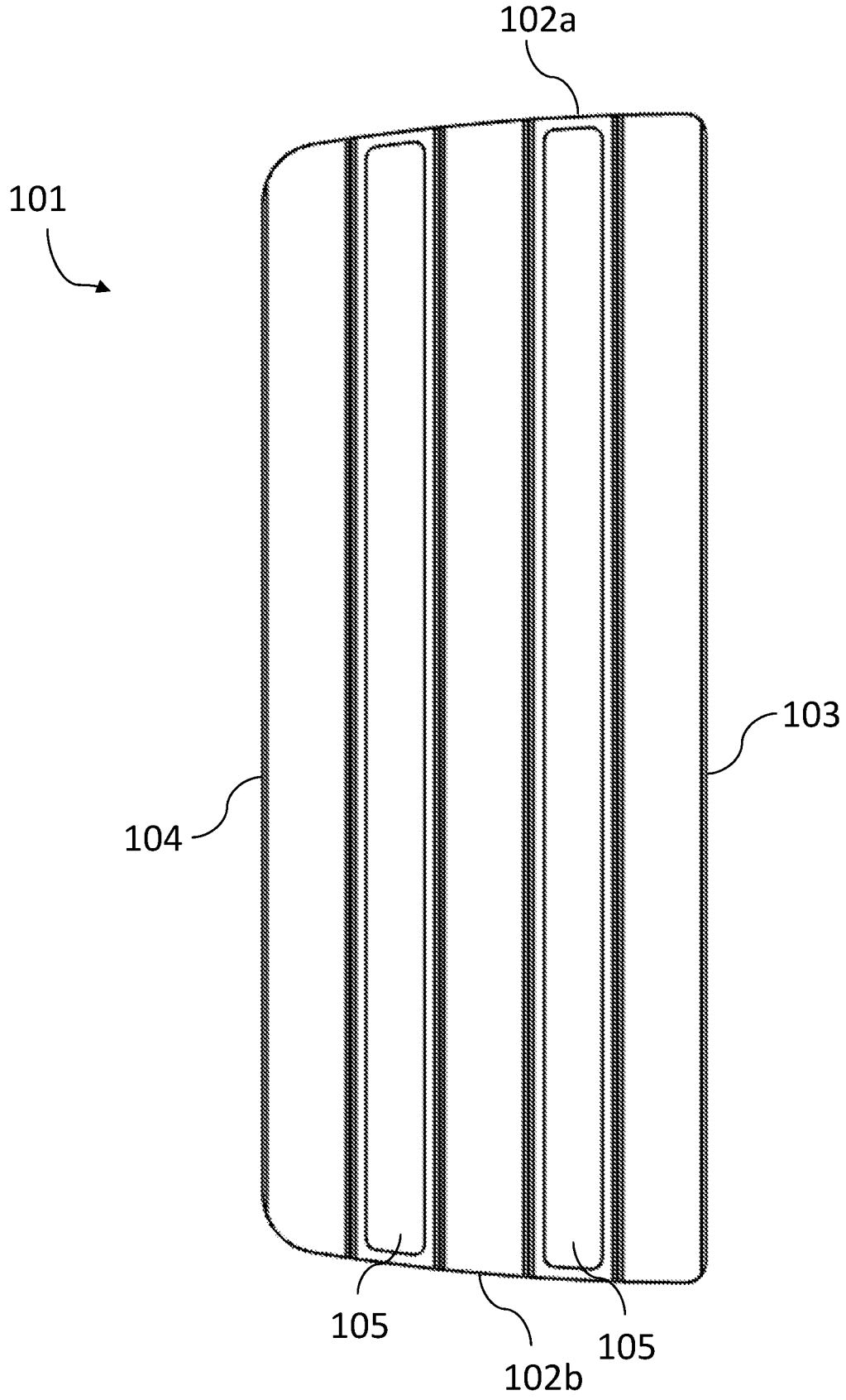
FIG. 9 illustrates a step platform of the steps of FIG. 1.

FIG. 9 illustrates a top view of a step platform 101 of the steps 100 of FIG. 1. The illustrated step platform 101 may be either a top step platform 101 or a bottom step platform 101, as the step platforms 101 are interchangeable. The step platform 101 includes opposing side edges 102*a*, 102*b*, a long straight edge 103, and a shorter straight edge 104 opposite the long straight edge 103. The long straight edge 103 may be for aligning over and fastening to the top edge 13 of the panels 10. The opposing curved edges 102*a*, 102*b* may be for aligning over and fastening to the side panels 16. Additionally, the step platform 101 includes treads 105 that may increase a friction of the step platform 101 to prevent a user from slipping on the steps 100.

Figure 10:
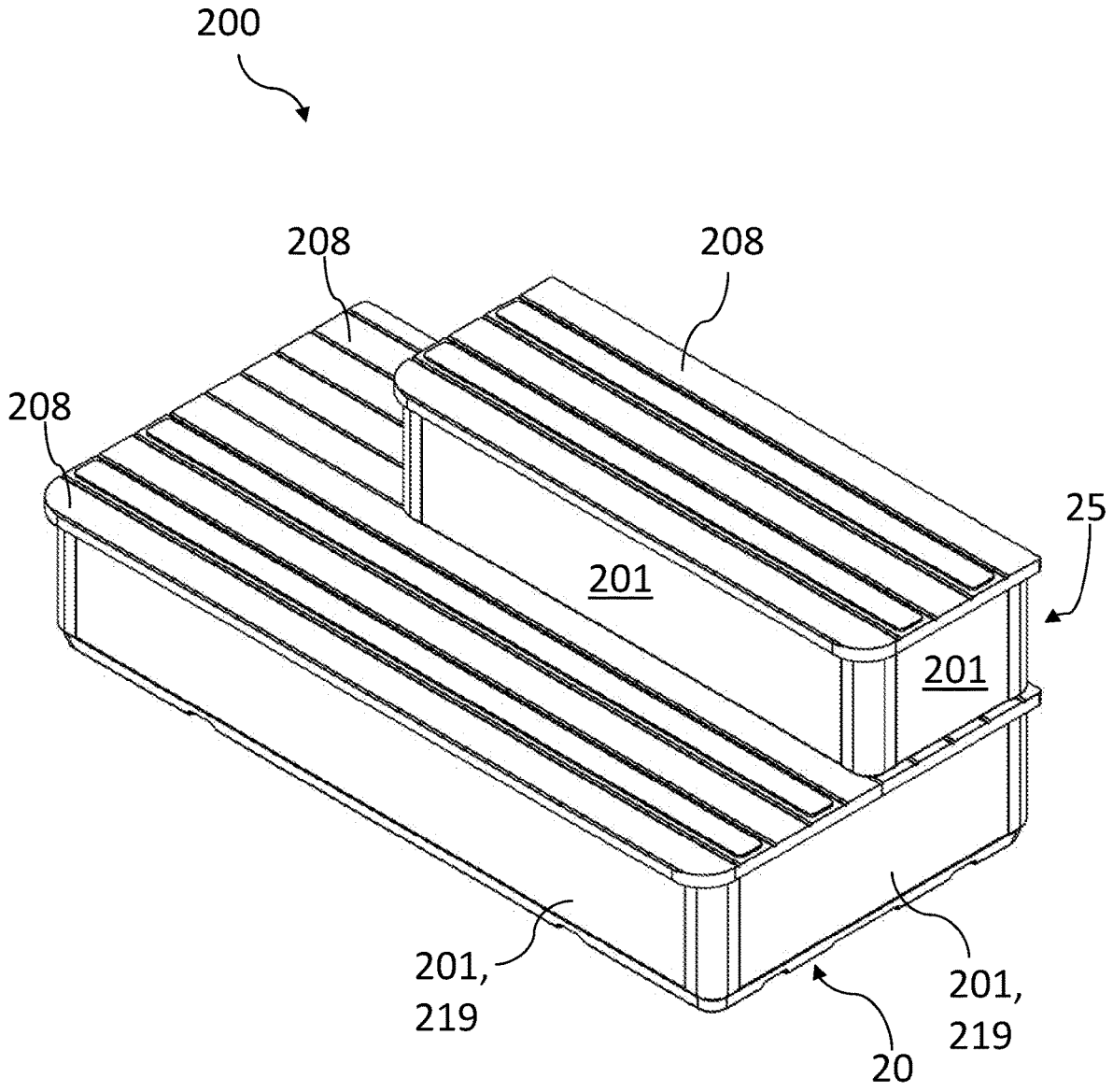
FIG. 10 illustrates another embodiment of steps for a spa.
Figure 11:
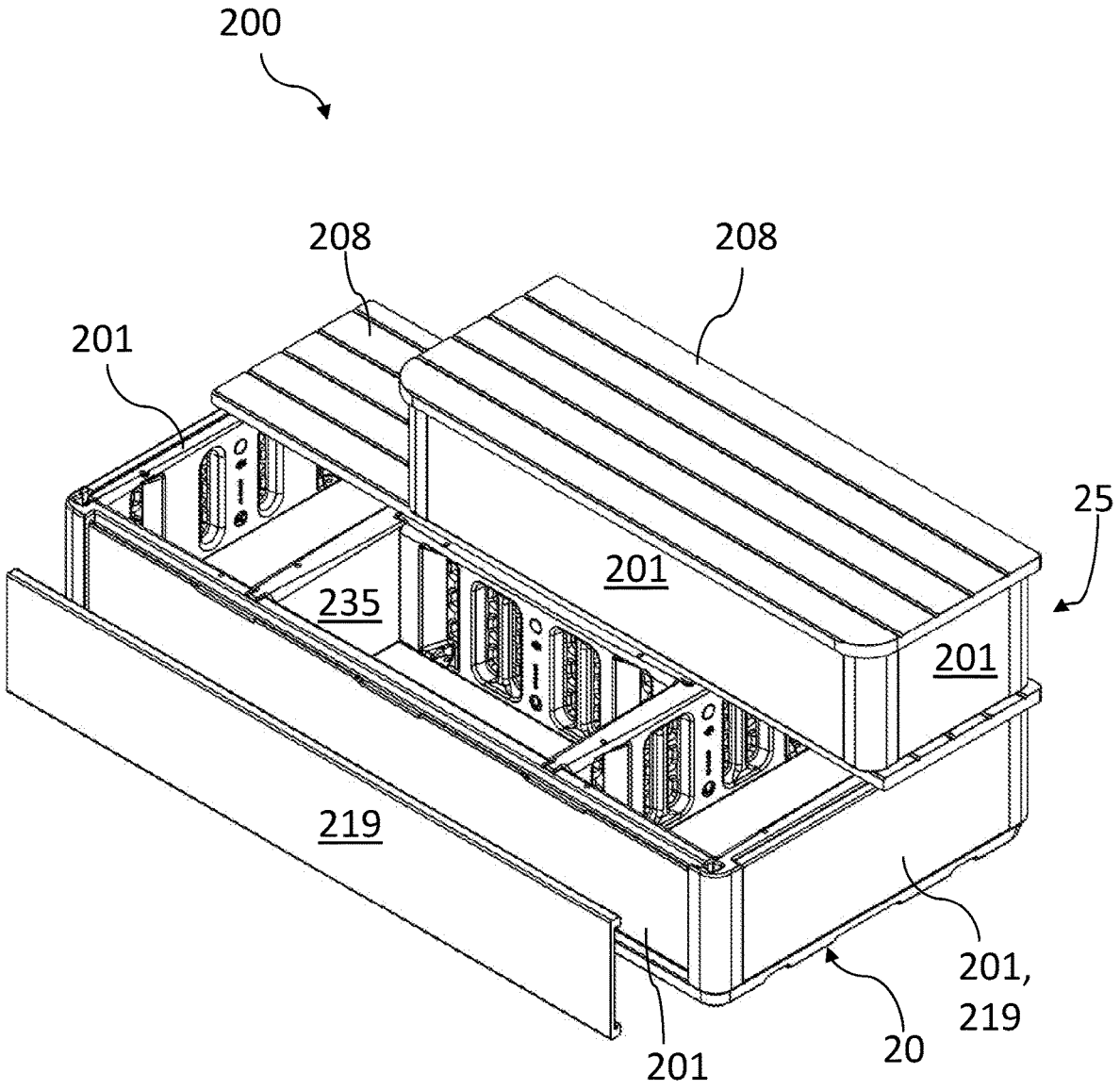
FIG. 11 illustrates a partially exploded view of the steps of FIG. 10.

Turning now to FIGS. 10-11, another embodiment of steps 200 for a spa are shown. FIG. 10 illustrates a perspective view of steps 200 for a spa and FIG. 11 illustrates a partially exploded view of the steps 200 of FIG. 10. Referring to FIGS. 10-11, the steps 200 include a lower frame 20, one or more step platforms 208 arranged over the lower frame 20, an upper frame 25 arranged over a back portion of the lower frame 20 and the one or more step platforms 208, and a step platform 208 arranged over the upper frame 25. The upper frame 25 may be positionable over the back portion of the lower frame 20 and the one or more step platforms 208 in multiple positions, including a first position (see FIGS. 18-19), a second position (see FIGS. 20-21), and a third position (see FIGS. 22-23).

The lower frame 20 and the upper frame 25 may be formed from a plurality of structural panels 201, where each structural panel 201 connects to an adjacent structural panel 201 and receives a decorative panel 219. The decorative panel 219 may include a woodgrain pattern, another pattern, a color, another decorative feature, etc., and may match any decorative paneling of the spa. In this way, the steps 200 will appear as though they originally came with the spa and/or match the aesthetics of the spa. When the steps 200 match the spa they are arranged next to, the entire spa experience for a user is aesthetically enhanced. Additionally, in this way, the steps 200 can be changed to match any changes in decorative paneling of the spa; alternatively, the decorative panels 219 of the steps 200 may be different and not match decorative paneling of the spa. When the steps 200 are fully assembled (as in FIG. 10), only corners of the structural panels 201 are visible and the decorative panel 219 is fully visible.

The lower frame 20 may additionally include interior panels 235, three of which are visible in FIG. 11. In some embodiments, the interior panels 235 are the panels 10 of the steps 100 of FIGS. 1-9 (see FIGS. 5A-6B).

Figure 12:
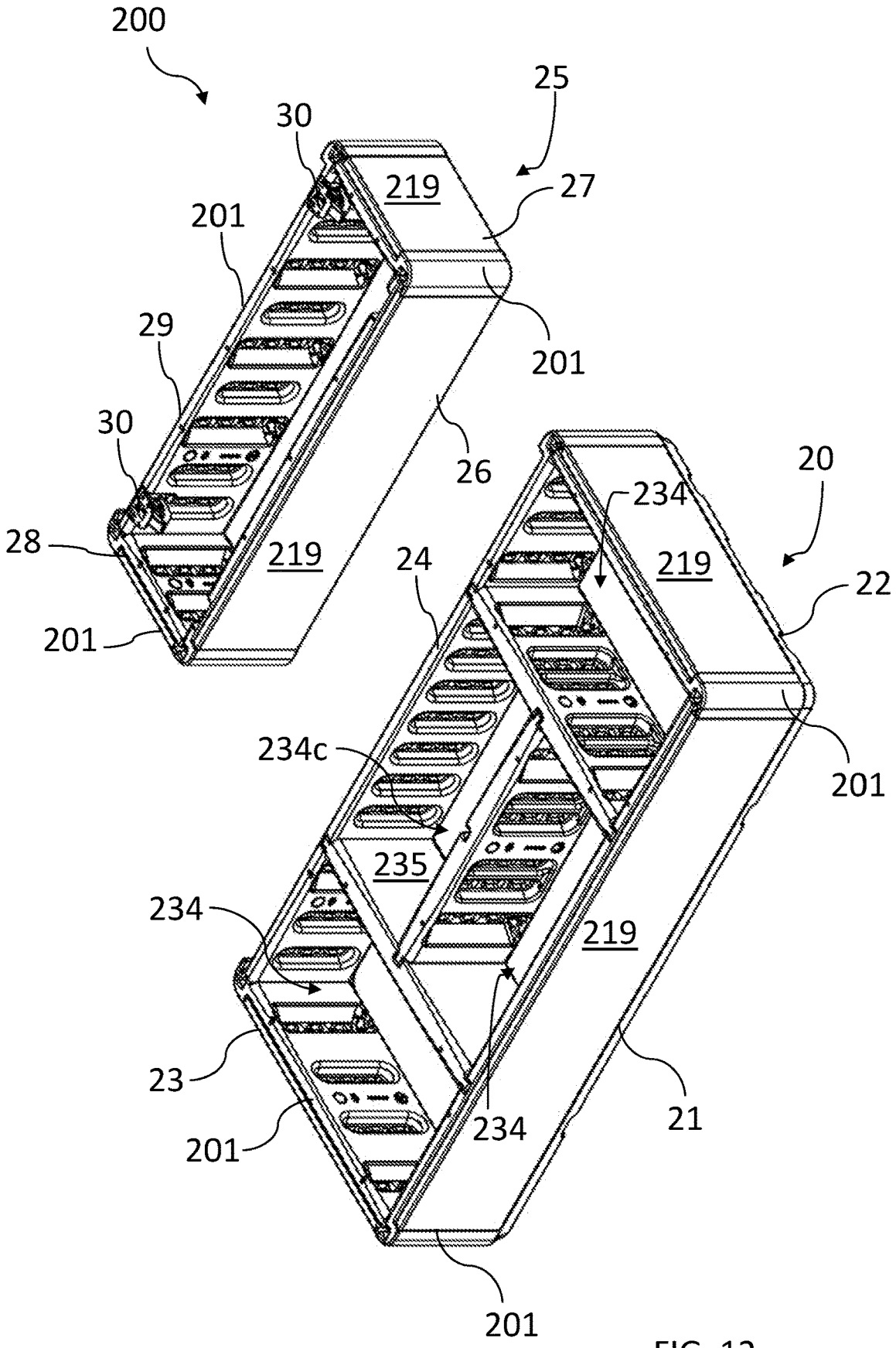
FIG. 12 illustrates a partially exploded view of the steps of FIG. 10, where the step platforms have been removed and the interior of the steps is visible.
Figure 13:
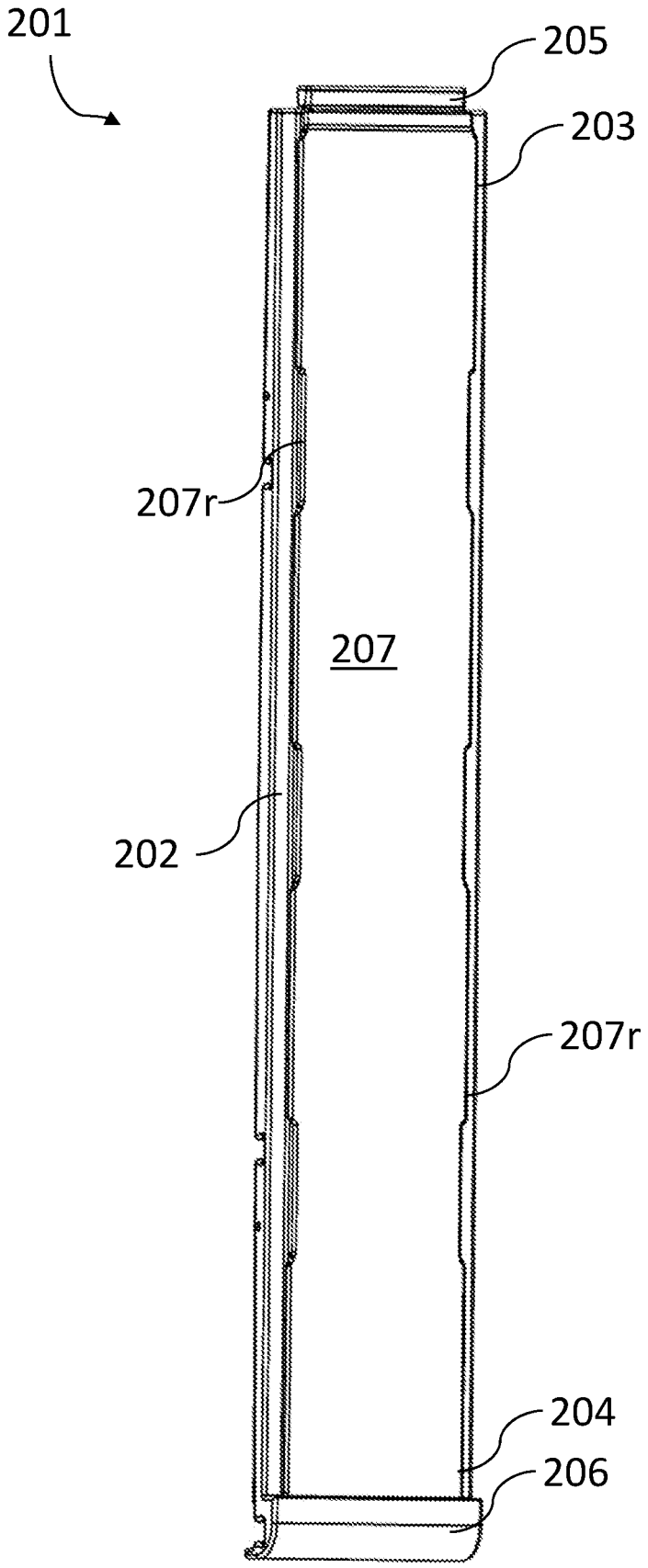
FIG. 13 illustrates a front view of an embodiment of a structural panel of the steps of FIG. 10.
Figure 14:
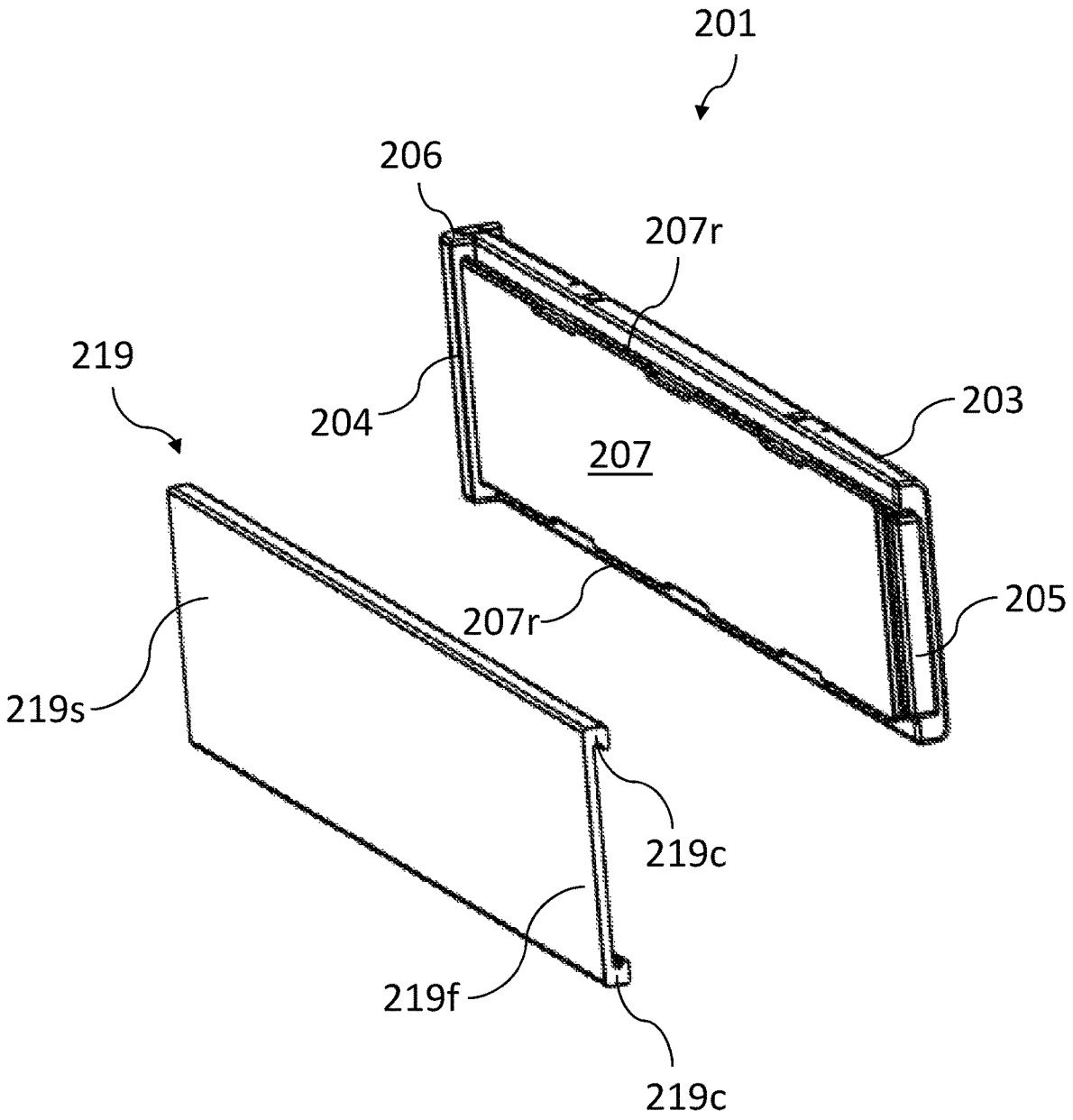
FIG. 14 illustrates a front perspective exploded view of the structural panel(s) and decorative panel(s) of FIGS. 10-13.

FIG. 12 illustrates a partially exploded view of the steps 200 of FIG. 10, where the step platforms 208 have been removed and the interior of the steps 200 is visible. A step platform 208 may be hingedly attached to the upper frame 25 through hinges 30. Clearly illustrated are the interior panels 235, which may define one or more hollow spaces or compartments 234 in the lower frame 20. The hollow spaces 234 may be for storing spa accessories or chemicals. For example, the upper frame 25 may be hollow and may be positionable over the lower frame 20, such that the hollow upper frame 25 is aligned with a central hollow space 234*c*. As the chemicals typically used with a spa come in bottles that are fairly tall and should be stored vertically, the central hollow space 234*c* in the lower frame 20, together with the hollow upper frame 25, can accommodate the height of the bottles and provide a convenient storage space for the chemical bottles.

The lower frame 20 has a front edge or face 21, a first side edge or face 22, a second opposing side edge or face 23, and a back edge or face 24. Similarly, the upper frame 25 has a front edge or face 26, a first side edge or face 27, a second opposing side edge or face 29, and a back edge or face 29. As discussed herein, the upper frame 25 is positionable over the lower frame 20 in a plurality of positions. In each position, the back edges or faces 24, 29 of the lower and upper frame 20, 25 are aligned or substantially aligned. In a first configuration, the first side edge or face 27 of the upper frame 25 is aligned or substantially aligned with the first side edge or face 22 of the lower frame. In a second configuration, the upper frame 25 is positioned over the central hollow space 234*c* and about a center of the lower frame 20. In a third configuration, the second side edge or face 28 of the upper frame 25 is aligned or substantially aligned with the second side edge or face 23 of the lower frame.

FIGS. 13-16 illustrate various views of a structural panel 201 of the steps 200 of FIG. 10. In some embodiments, each of the structural panels 201 have the same configuration (e.g., are the same), with a length of each structural panel 201 being determined by where in the steps 200 the structural panel is incorporated. For example, the side structural panels 201 will be shorter than the front and back structural panels 201.

Each structural panel 201 includes a body 202 with a first end 203 and an opposing second end 204. Extending from the first end 203 is a tenon or projection 205, which may be the same shape as the tenon 15 of FIG. 6. Incorporated in the second 204 is a mortice or slot 206, which may be the same shape as the mortices 18 of FIGS. 4A-4B. As with the tenons 15 and mortices 18, a tenon 205 of a first structural panel 201 may be slidably received by a mortice 206 of a second, adjacent structural panel 201. This allows for easy, tool-free connection of the structural panels.

Extending from the body 202 may be a face plate 207 forming rails 207*r* to slidably receive the decorative panel 219. The face plate 207 may be the front of the structural panel 201. In some embodiments, the rails 207*r* are integral to the body 202. The decorative panels 219 may each include clamps or channels 219*c* (see FIG. 14) that slide onto the rails 207*r* and receive the rails 207*r*. For example, as illustrated in FIG. 15B, the clamps 219*c* may slide over the rails 207*r* such that the decorative panel 219 is flush or substantially flush with the face plate 207 and/or the body 202. The decorative panels 219 may have a first end 219*f* and an opposing second end 219*s*.

Figure 15A:
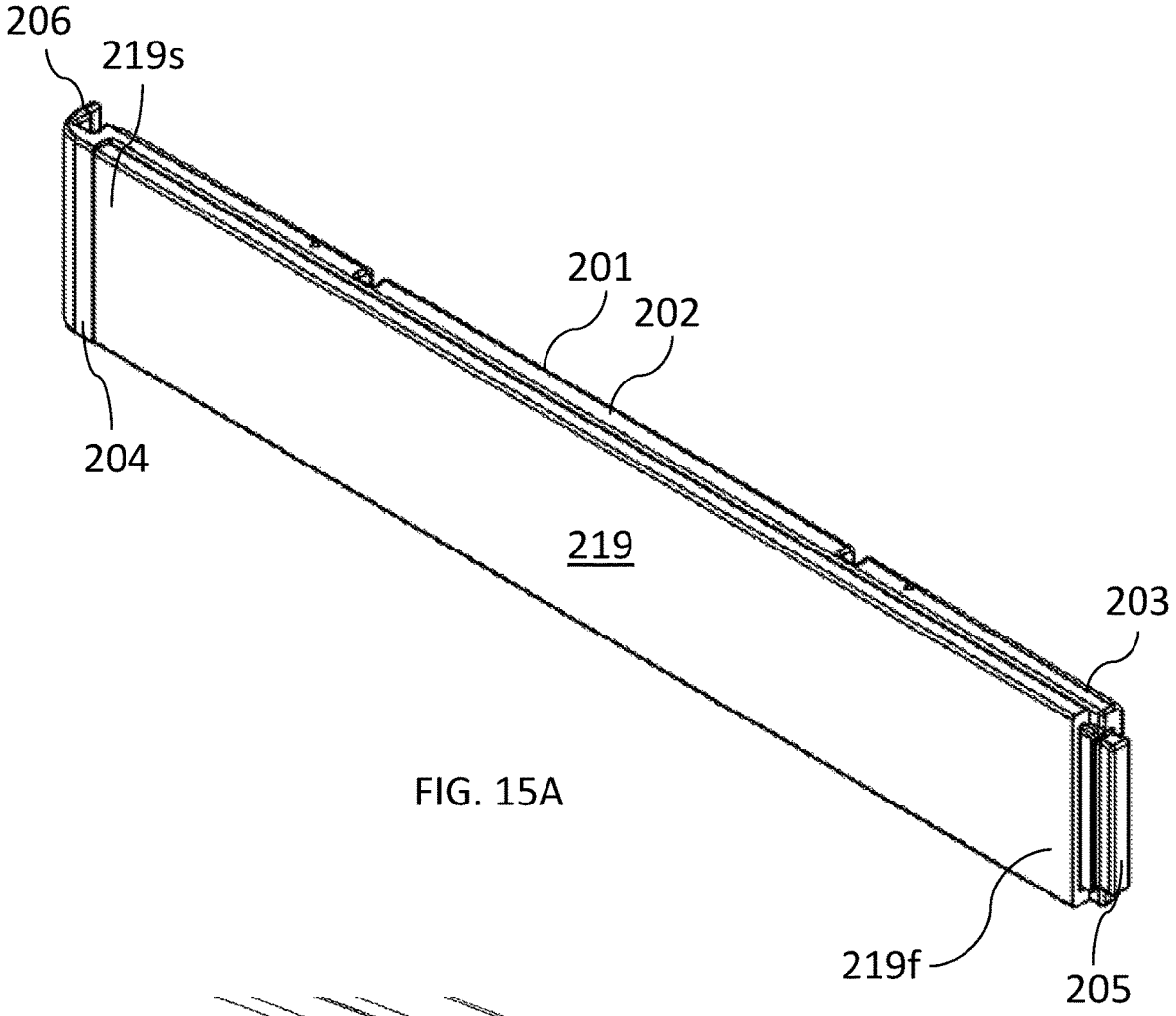
FIG. 15A illustrates a front perspective view of the structural panel(s) having slidably received the decorative panel(s) and FIG. 15B illustrates a perspective cross-sectional view of the decorative panel slidably received by the structural panel of FIG. 15A.
Figure 15B:
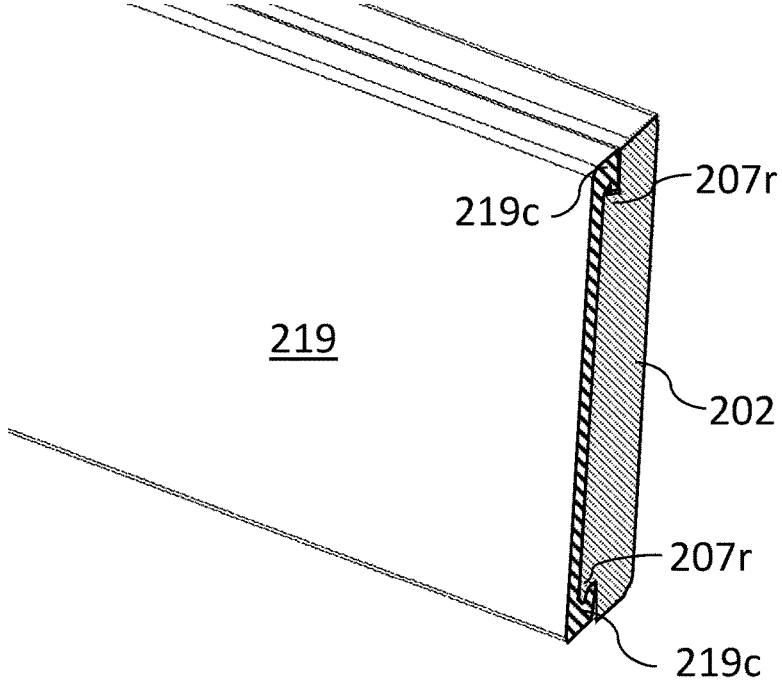
Figure 16:
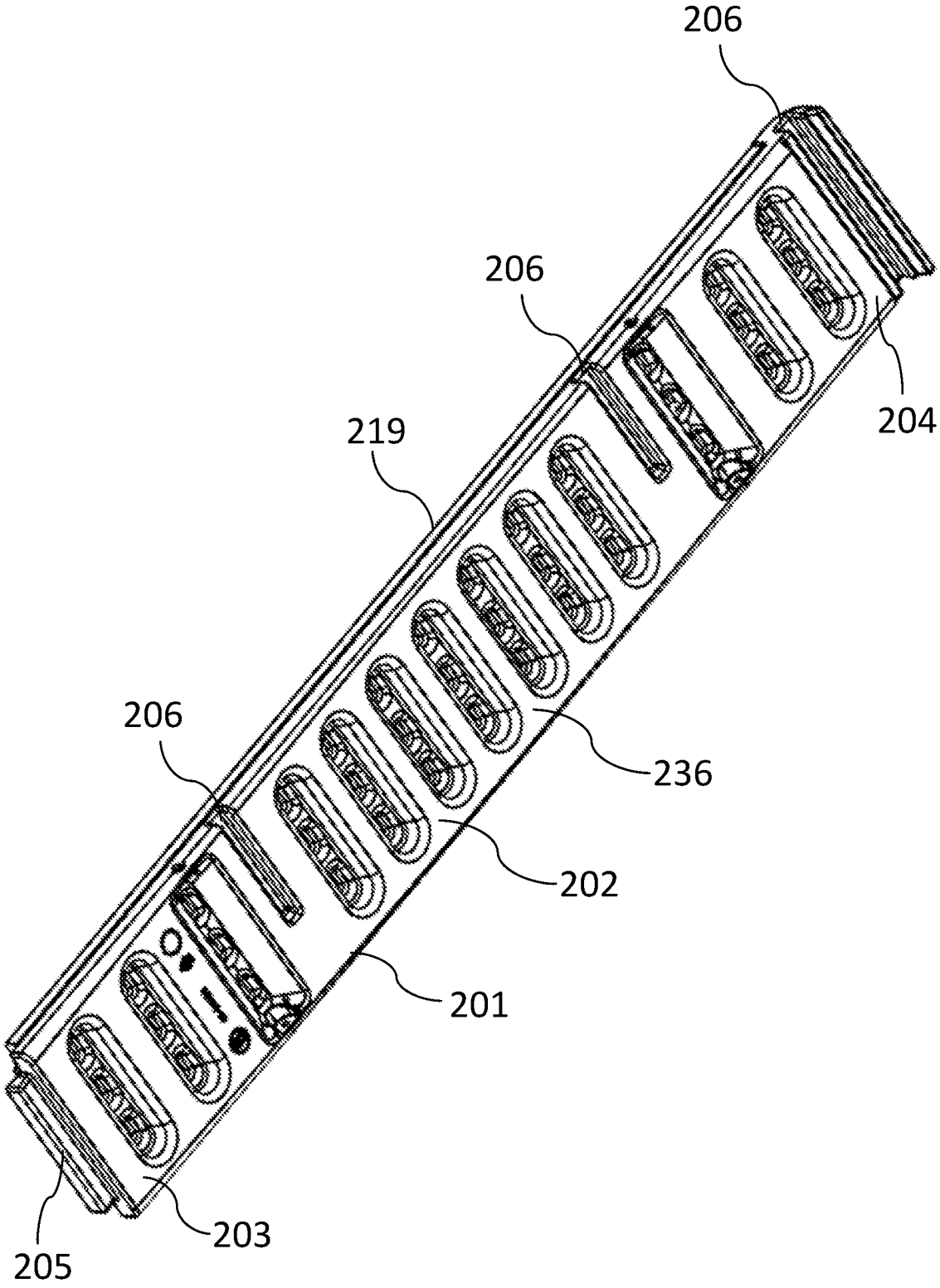
FIG. 16 illustrates a back perspective view of the structural panel and decorative panel of FIG. 15.

When the decorative panel 219 is slid onto the rails 207*r* and is in position over the structural panel 201, the second end 219*s* of the decorative panel 219 may abut the second end 204 of the structural panel 201, and the first end 219*f* of the decorative panel 219 may abut the first end 203 of the structural panel 201 (see FIG. 15). The first end 219*f* of the decorative panel 219 may be "free" to slide along the rails 207*r*, in that the decorative panel 219 may be slid on or off of the rails 207*r*, until a mortice 206 of a second adjacent structural panel 201 is connected to the tenon 205 of the structural panel 201 carrying the decorative panel 219. In this way, the decorative panel 219 may be locked onto the structural panel 201. By disconnecting the two structural panels 201 (e.g., by disengaging the tenon 205 from the mortice 206), the decorative panel 219 may be removed and replaced with a different decorative panel 219. This allows the steps to be customized with the desired decorative panels without having to make different parts to blow mold the steps. This also allows the steps to be formed from blow-molded materials while having the "look" of being formed from non-blow-molded materials.

A back 236 of the structural panels 201 may define additionally mortices 206, which may be for engaging the internal panels 235. Additionally, similar to the panels 10 of FIGS. 1-9, the back 236 of the structural panels 201 may include a plurality of depressions, which may make the formed structural panels 201 lighter and easier to maneuver for a user. The structural panels 201 may be formed in a blow-molding process.

Figure 17:
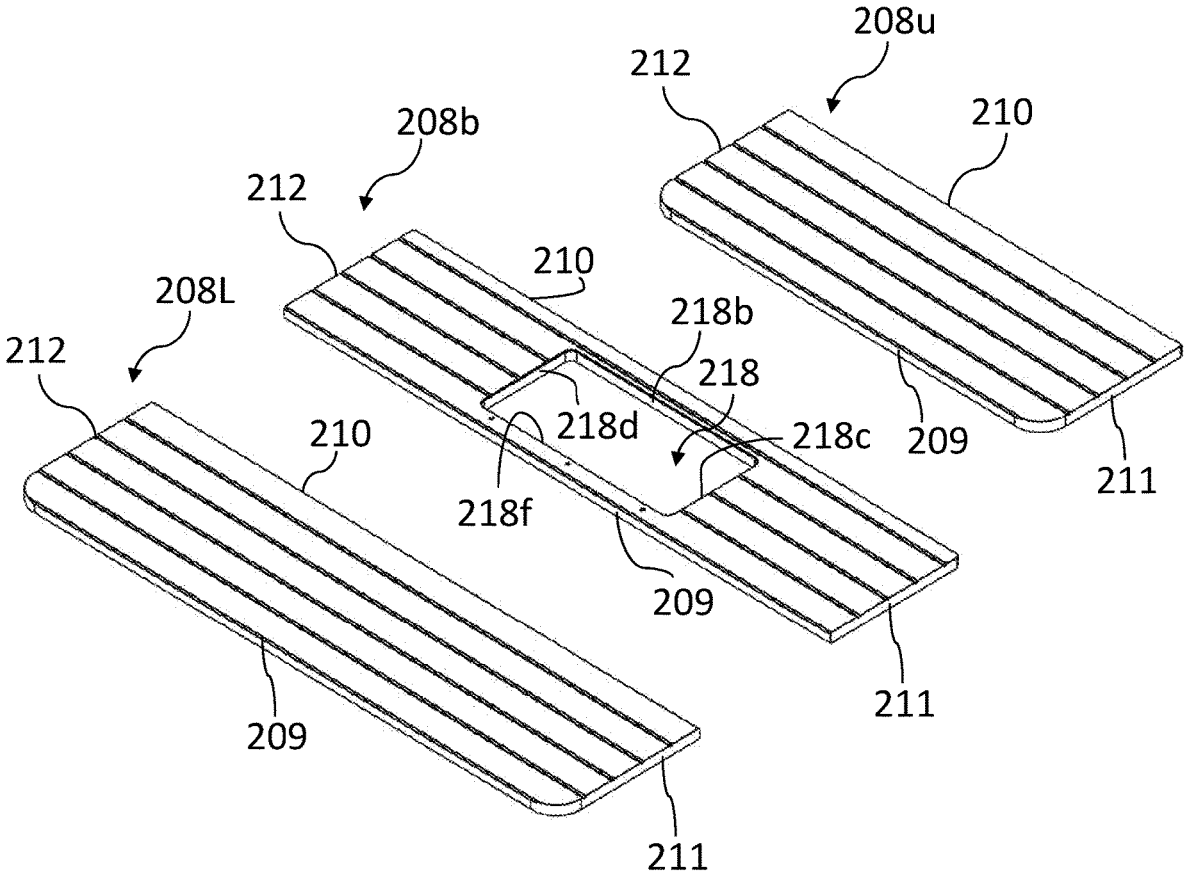
FIG. 17 illustrates a front exploded perspective view of the step platforms of the steps of FIG. 10.

FIG. 17 illustrates a front perspective view of the step platforms 208 of the steps 200 of FIG. 10. In some embodiments, the step platforms 208 included rounded corners. Each of the step platforms 208 may include a front edge 209, a back edge 210 opposite the front edge 209, a first side edge 211, and an opposing second side edge 212. The step platforms 208 may include an upper step platform 208*u*, a lower step platform 208L, and a lower back step platform 208*b*. The upper step platform 208*u* may be arranged over the upper frame 25. The lower step platforms 208L, 208*b* may be arranged over the lower frame 20. The front edge 209 of the lower back step platform 208*b* may abut the back edge 210 of the lower step platform 208L when the two are assembled over the lower frame 20.

The lower back step platform 208*b* may define a window 218, which provides access to the hollow spaces 234 defined within the lower frame 20. The window 218 may include a front edge 218*f*, a back edge 218*b*, a first side edge 218*c*, and an opposing second side edge 218*d*. The upper frame 25 may be positionable over the window 218 in a plurality of positions.

Figure 18:
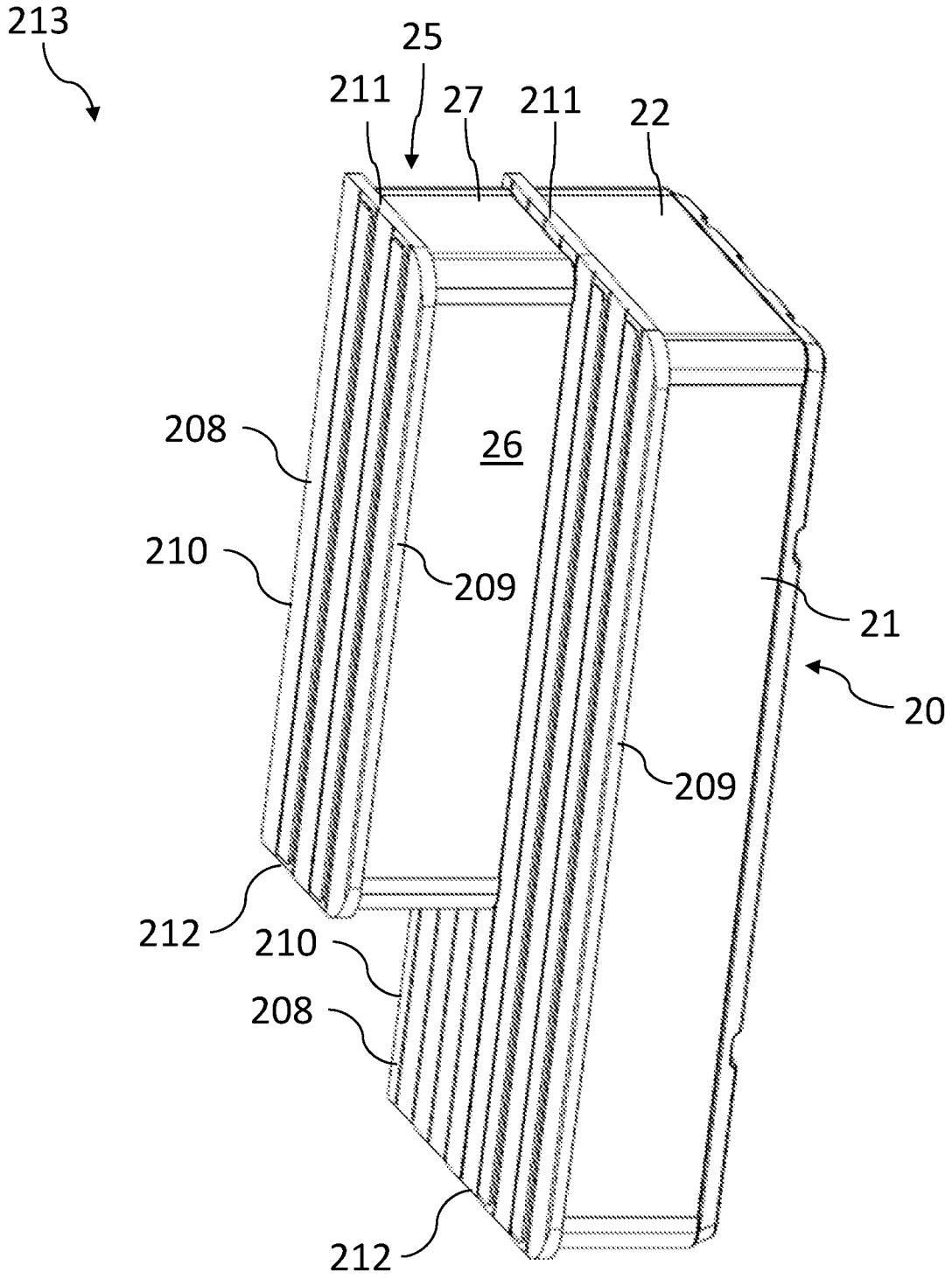
FIG. 18 illustrates the steps of FIG. 10 in a first configuration or arrangement.
Figure 19:
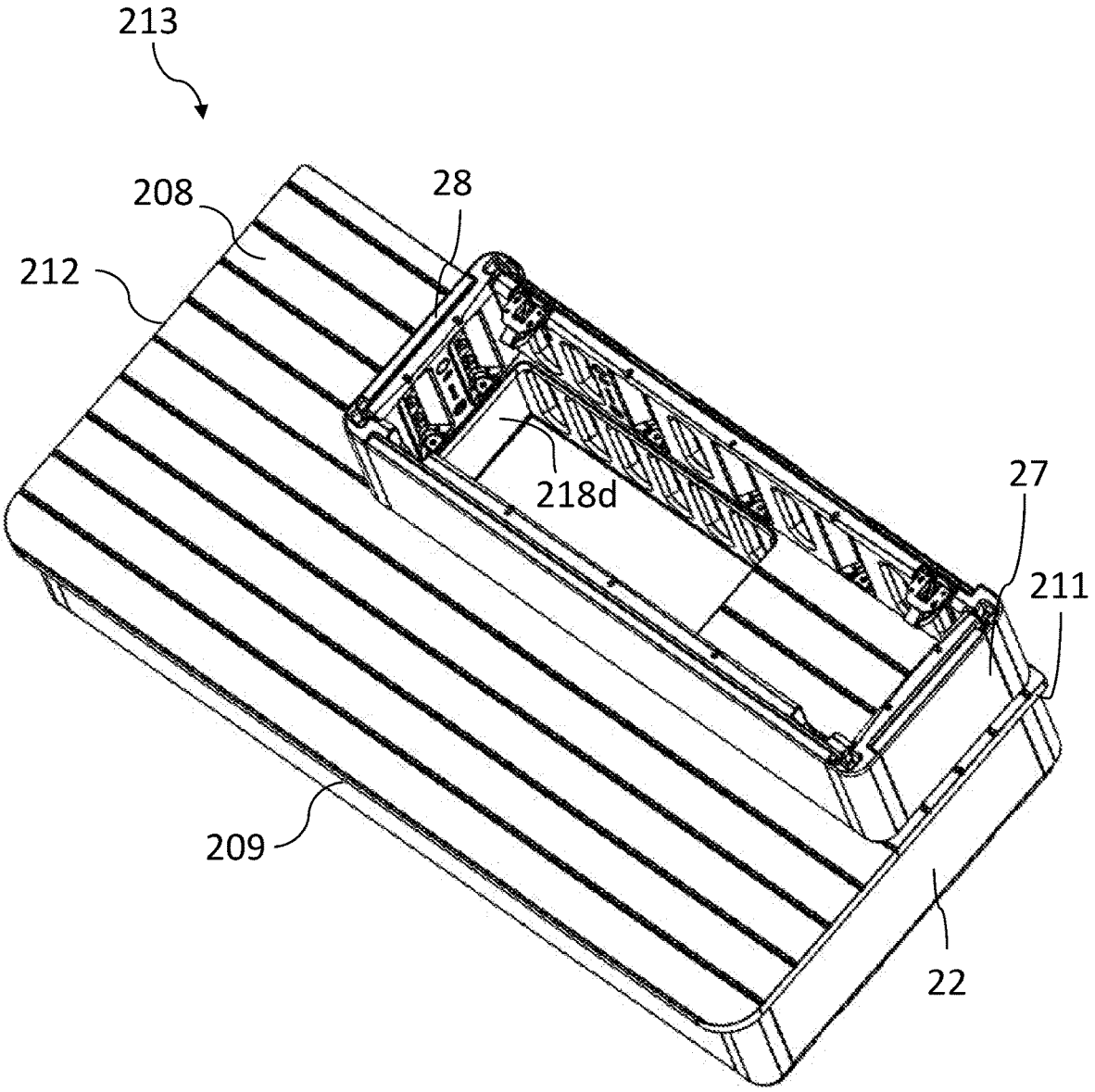
FIG. 19 illustrates the first configuration or arrangement of FIG. 18 with a step platform removed such that a portion of the interior of the steps is visible.

FIGS. 18-19 illustrate the steps 200 of FIG. 10 in a first configuration or position 213. In the first position 213, the upper frame 25 is arranged over the lower frame 20 such that the first side edges or faces 27, 22 of the frames 25, 20 are aligned or substantially aligned. Additionally, the first side edges 211 of the step platforms 208 are aligned or substantially aligned. As seen in FIG. 19, the second edge 28 of the upper frame 25 is aligned or substantially aligned with the second edge 218*d* of the window 218. In this way, a user may hinge open the step platform 208 connected to the upper frame 25 (via hinges 30), to access the lower compartments 234 defined within the lower frame 20 via the window 218.

Figure 20:
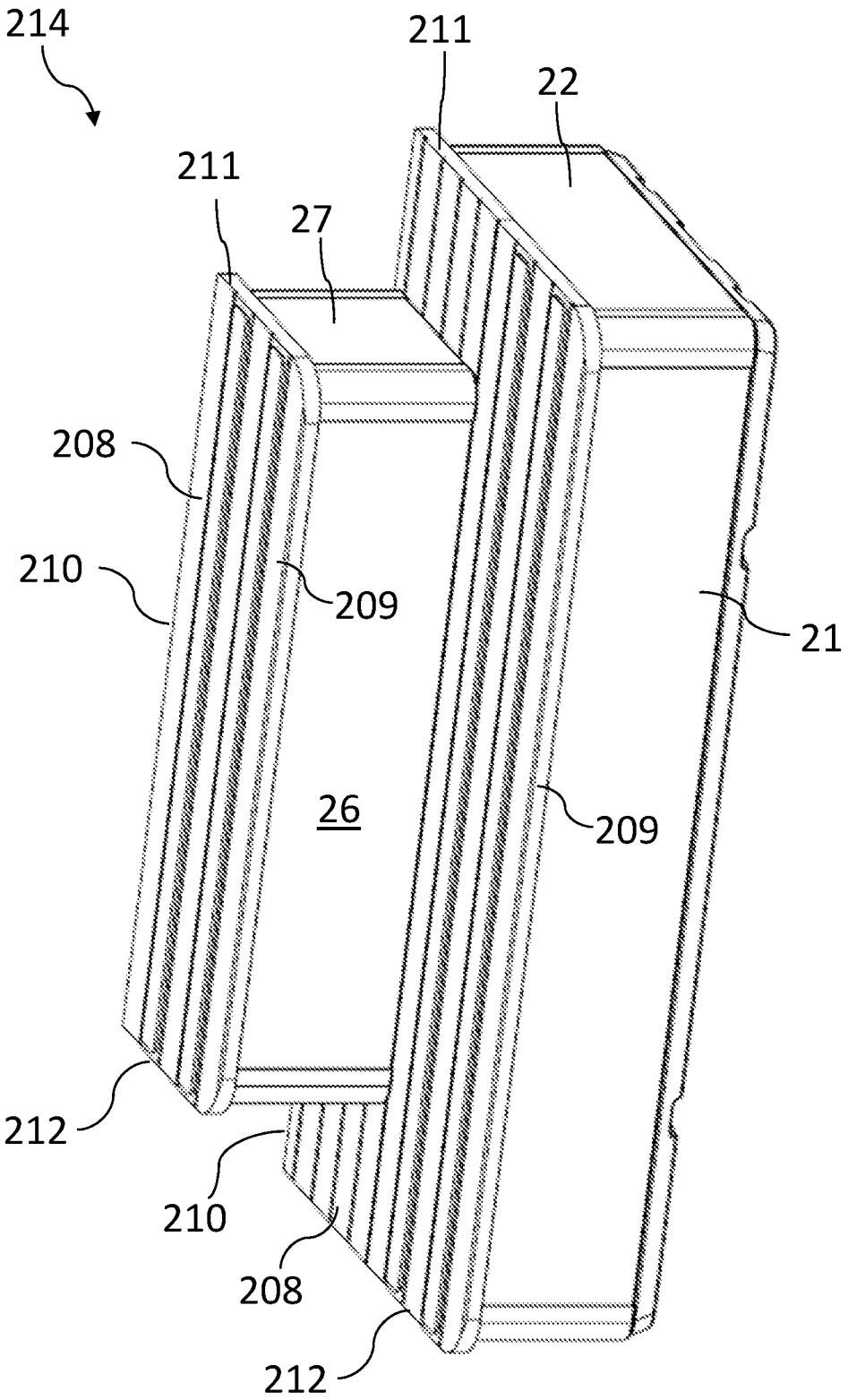
FIG. 20 illustrates the steps of FIG. 10 in a second configuration or arrangement.
Figure 21:
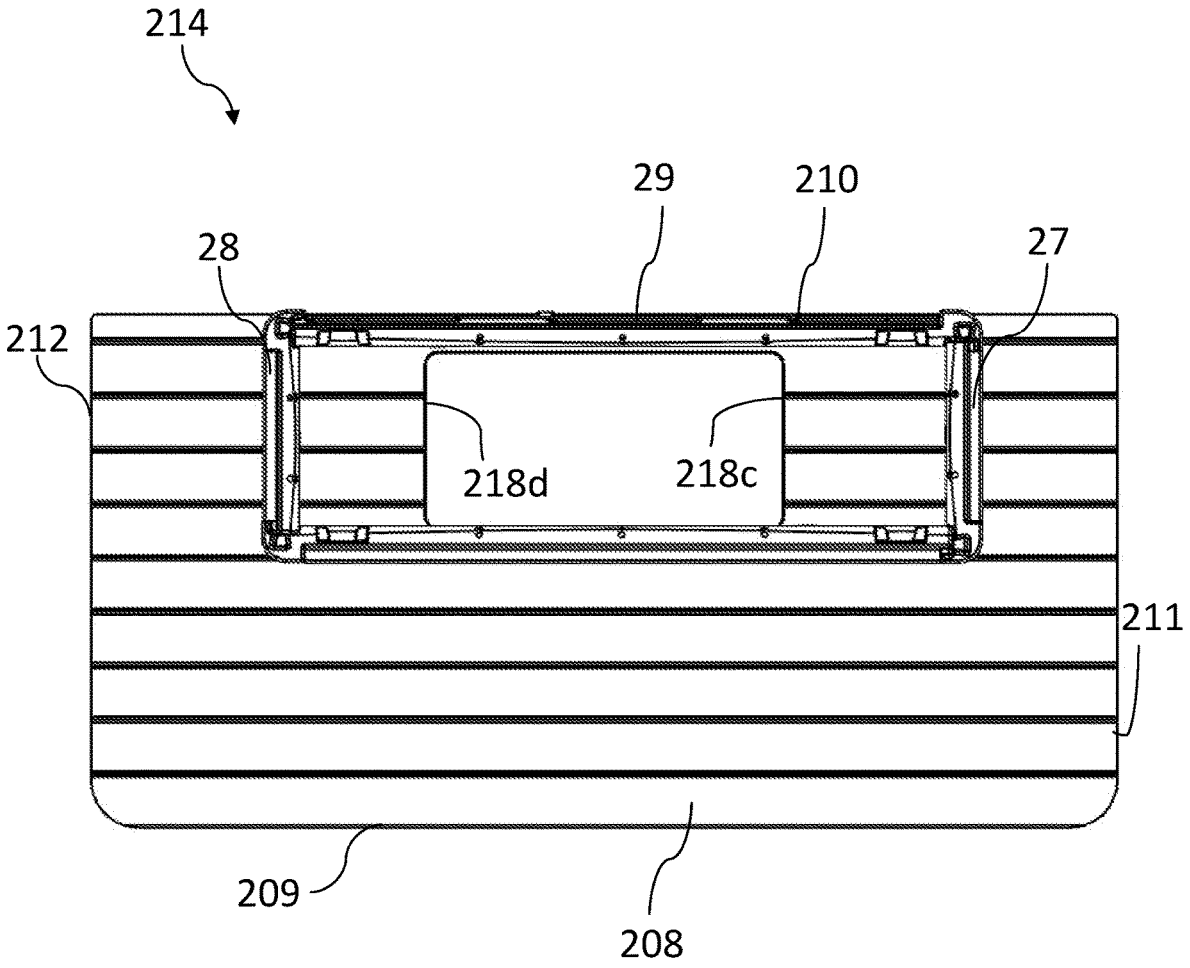
FIG. 21 illustrates the second configuration or arrangement of FIG. 20 with a step platform removed such that a portion of the interior of the steps is visible.

FIGS. 20-21 illustrate the steps 200 of FIG. 10 in a second configuration or arrangement 214. In the second position 214, the upper frame 25 is positioned substantially in the middle over the lower frame 20. The first edge 27 of the upper frame 25 is spaced a distance from the first edge 22 of the lower frame 20, and the second edge 28 is spaced a distance from the second edge 23 of the lower frame 20. Additionally, the upper frame 25 is substantially centered over the window 218. In this way, a user may hinge open the step platform 208 connected to the upper frame 25 (via hinges 30), to access the lower compartments 234 defined within the lower frame 20 via the window 218.

Figure 22:
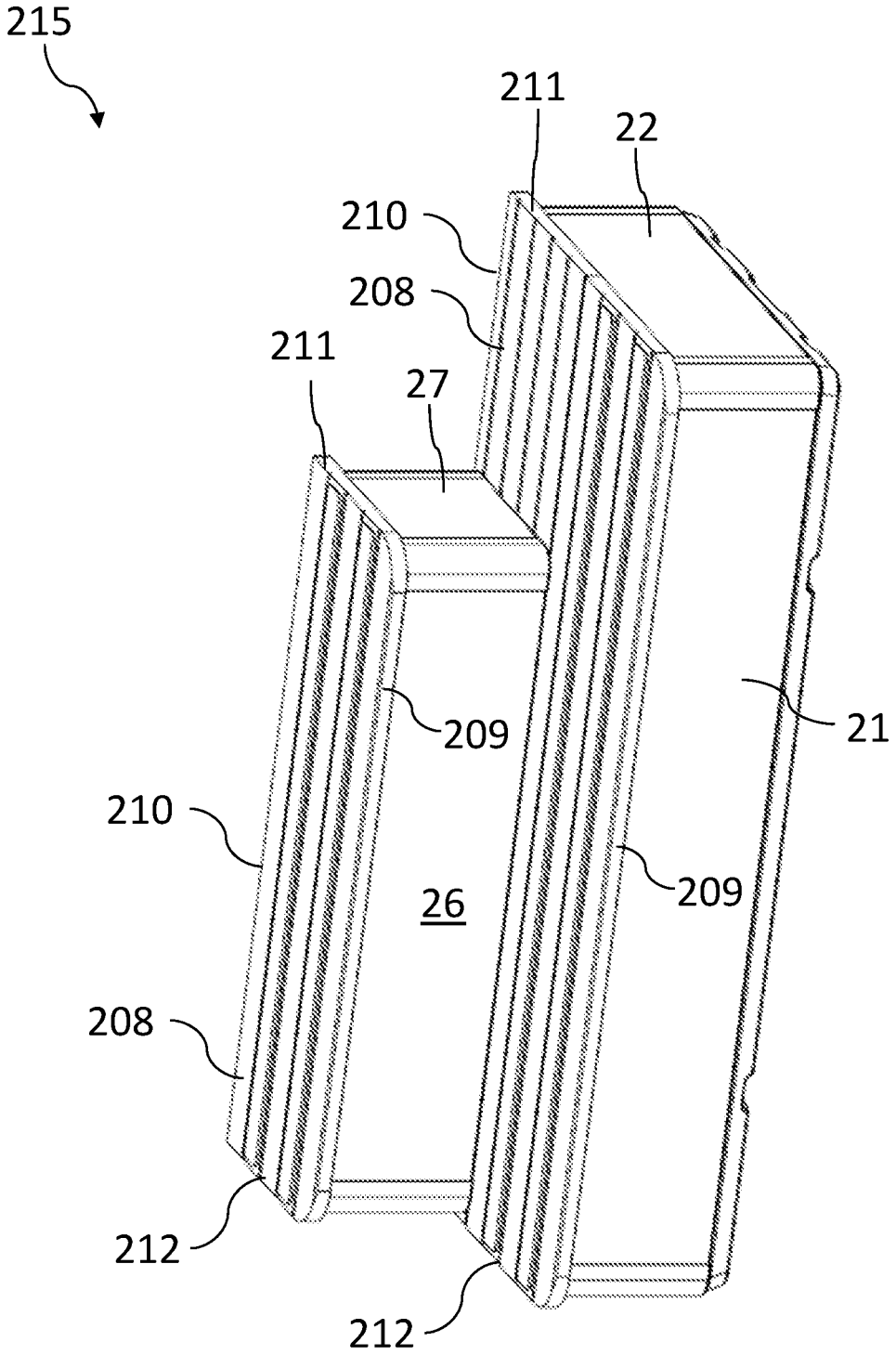
FIG. 22 illustrates the steps of FIG. 10 in a third configuration or arrangement.
Figure 23:
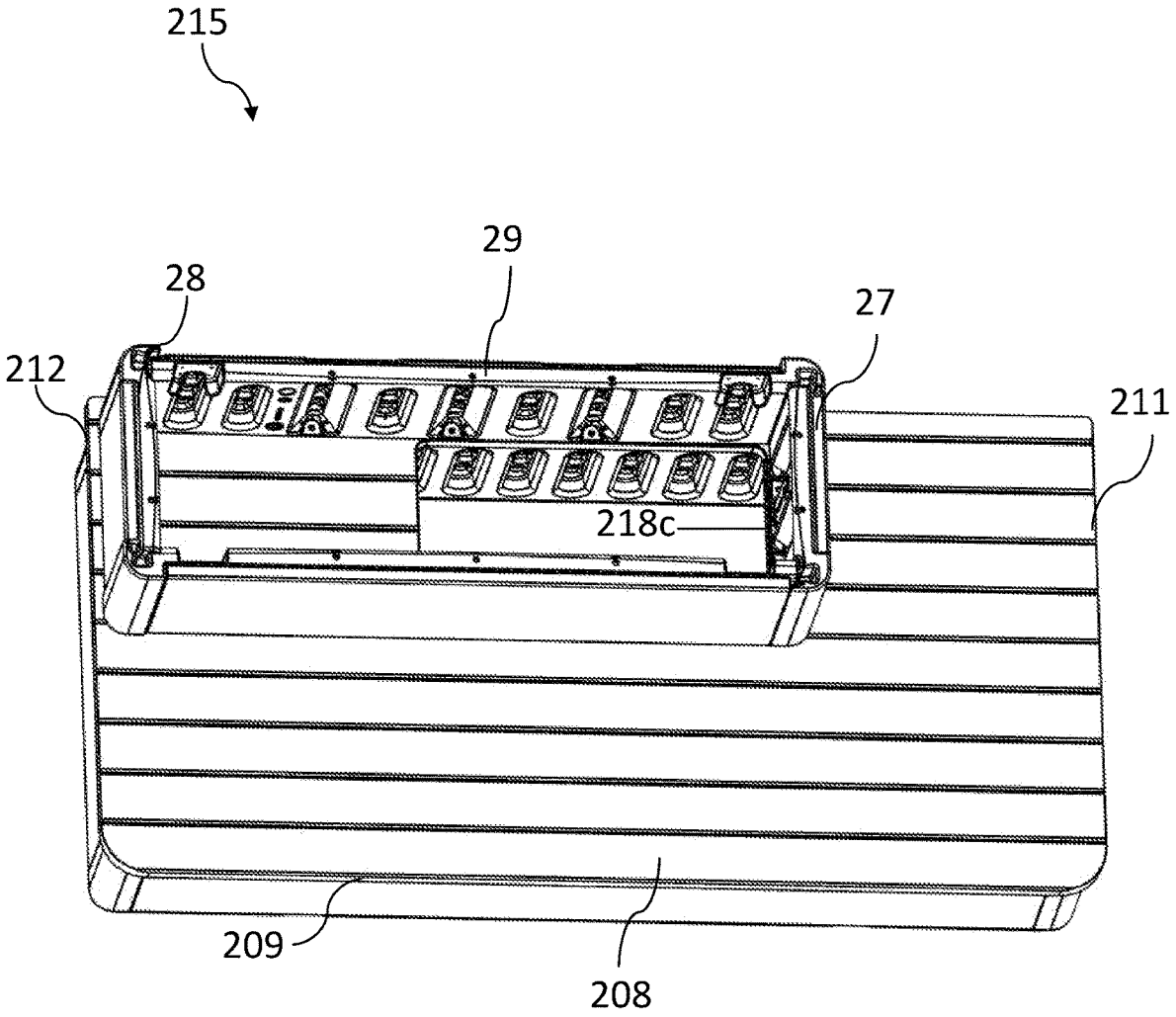
FIG. 23 illustrates the third configuration or arrangement of FIG. 22 with a step platform removed such that a portion of the interior of the steps is visible.

FIGS. 22-23 illustrate the steps 200 of FIG. 10 in a third configuration or arrangement 215. In the third position 215, the upper frame 25 is arranged over the lower frame 20 such that the second side edges or faces 28, 23 of the frames 25, 20 are aligned or substantially aligned. Additionally, the second side edges 212 of the step platforms 208 are aligned or substantially aligned. As seen in FIG. 23, the first edge 27 of the upper frame 25 is aligned or substantially aligned with the first edge 218*c* of the window 218. In this way, a user may hinge open the step platform 208 connected to the upper frame 25 (via hinges 30, see FIG. 12), to access the lower compartments 234 defined within the lower frame 20 via the window 218.

Figure 24:
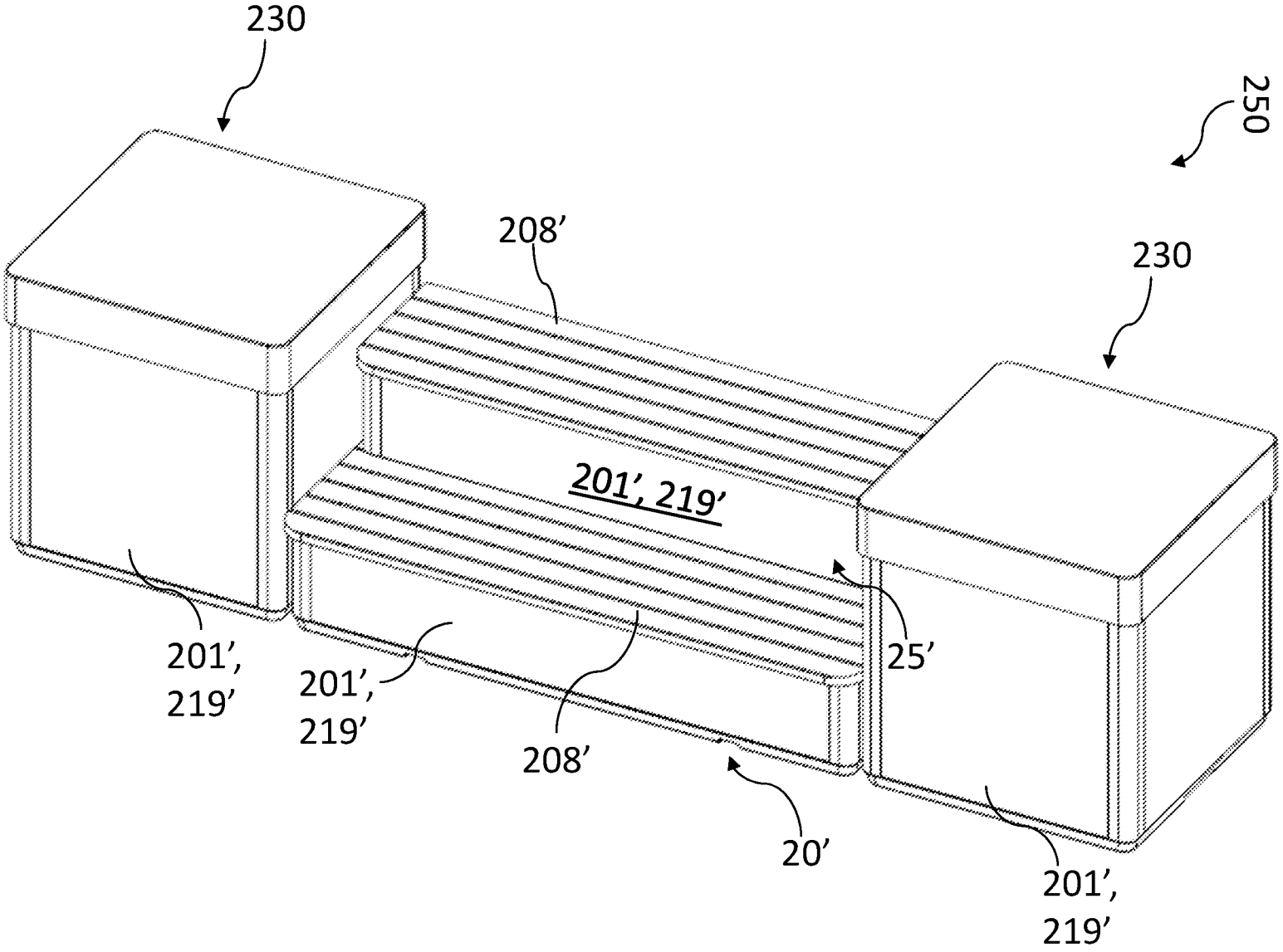
FIG. 24 illustrates another embodiment of steps for a spa.

Turning now to FIG. 24, another embodiment of steps 250 for a spa is shown. The steps 250 share features with the steps 200 illustrated in FIGS. 10-23. As such, like reference numerals will be used for like elements. As illustrated, the steps 250 include a lower frame 20', one or more step platforms 208' arranged over the lower frame 20', an upper frame 25' arranged over a back portion of the lower frame 20' and the one or more step platforms 208', a step platform 208' arranged over the upper frame 25', and one or more (such as two) containers 230. Similar to the steps 200, the upper frame 25' may be positionable over the back portion of the lower frame 20'. The containers 230 may flank the upper and lower frames 25', 20', or may be placed in another orientation about the upper and lower frames 25', 20'. The step platforms 208' may be similar to the step platforms 208 of FIG. 17. For example, an upper step platform 208*u* may be arranged over the upper frame 25'. The lower step platforms 208L, 208*b* may be arranged over the lower frame 20'. The front edge 209 of the lower back step platform 208*b* may abut the back edge 210 of the lower step platform 208L when the two are assembled over the lower frame 20'.

The lower frame 20', the upper frame 25, and the containers 230 may be formed from a plurality of structural panels 201', where each structural panel 201' connects to an adjacent structural panel 201' and receives a decorative panel 219'. The decorative panel 219' may be the decorative panel 219 illustrated in FIGS. 14-15. Accordingly, the decorative panel 219' may include a woodgrain pattern, another type of pattern, a color, another decorative feature, etc., and may match any decorative paneling of the spa. In this way, the steps 250 will appear as though they originally came with the spa. When the steps 250 match the spa they are arranged next to, the entire spa experience for a user is aesthetically enhanced. Additionally, in this way, the steps 250 can be changed to match any changes in decorative paneling of the spa; alternatively, the decorative panels 219' of the steps 250 may be different and not match decorative paneling of the spa. When the steps 250 are fully assembled (as in FIG. 24), only corners of the structural panels 201' are visible and the decorative panel 219' is fully visible.

Figure 25:
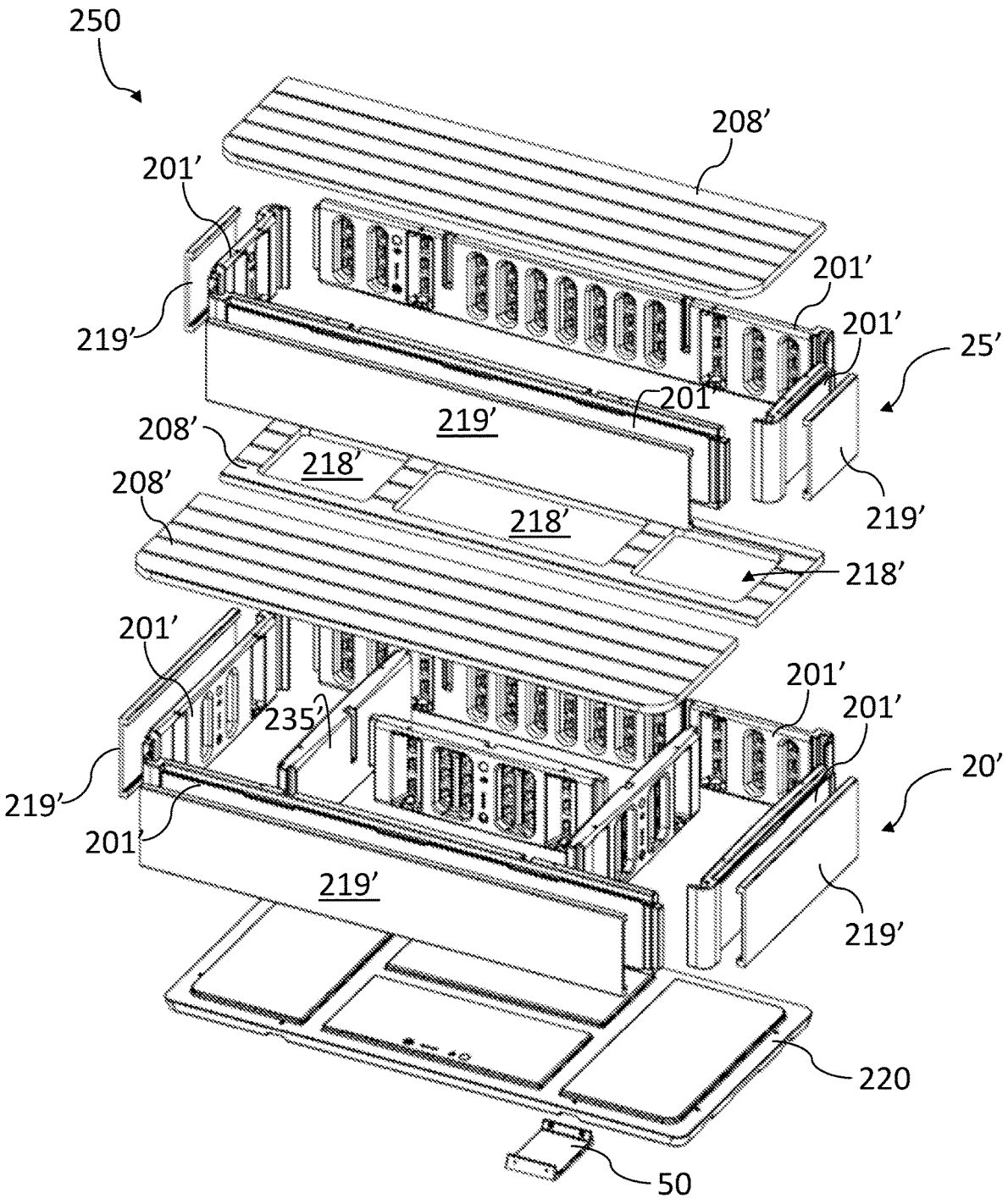
FIG. 25 illustrates an exploded view of the steps of FIG. 24, where the flanking containers have been removed for clarity.

FIG. 25 illustrates an exploded view of the steps 250 of FIG. 24, where the flanking containers 230 have been removed for clarity. The steps 250 include the lower frame 20', the upper frame 25', a bottom panel 220, and one or more connection mechanisms 50. Similar to the lower frame 20 of FIGS. 1-9, the lower frame 20' may include a plurality of internal panels 235' defining internal compartments 234' (see FIGS. 28-29).

Similar to the upper frame 25 of FIGS. 1-9, the upper frame 25' may be hollow and may be arranged over one or more windows 218'. As before, the windows 218' may provide access to a user to the internal compartments 234', such as for storing spa chemicals. Again, as the typical chemical bottle for a spa chemical is fairly tall and should be stored upright, the internal compartments 234' aligning with the windows 218', and the hollow upper frame 25' allows for adequate vertical height for storing tall chemical bottles. Also similar to the steps 200, the step platform 208' may hingedly attach to the upper frame 25', such as through hinges (not illustrated). This may allow easy access for the user to the spa chemicals, while keeping the chemicals out of sight.

The step platforms 208' may attach to the lower frame 20' and/or the upper frame 25' through one or more fasteners (e.g., fasteners 106). For example, top edges of the structural panels 201' may include one or more voids (e.g., voids 107) for receiving one or more fasteners. The fasteners may include screws, nails, pins, clips, snaps, or another type of fastener. Attaching the step platforms 208' to the lower frame 20' and/or the upper frame 25' only requires simple hand tools, such as a screw driver or an Allen wrench. In this way, the steps 250 are easy to assemble and disassemble as needed.

Figure 26:
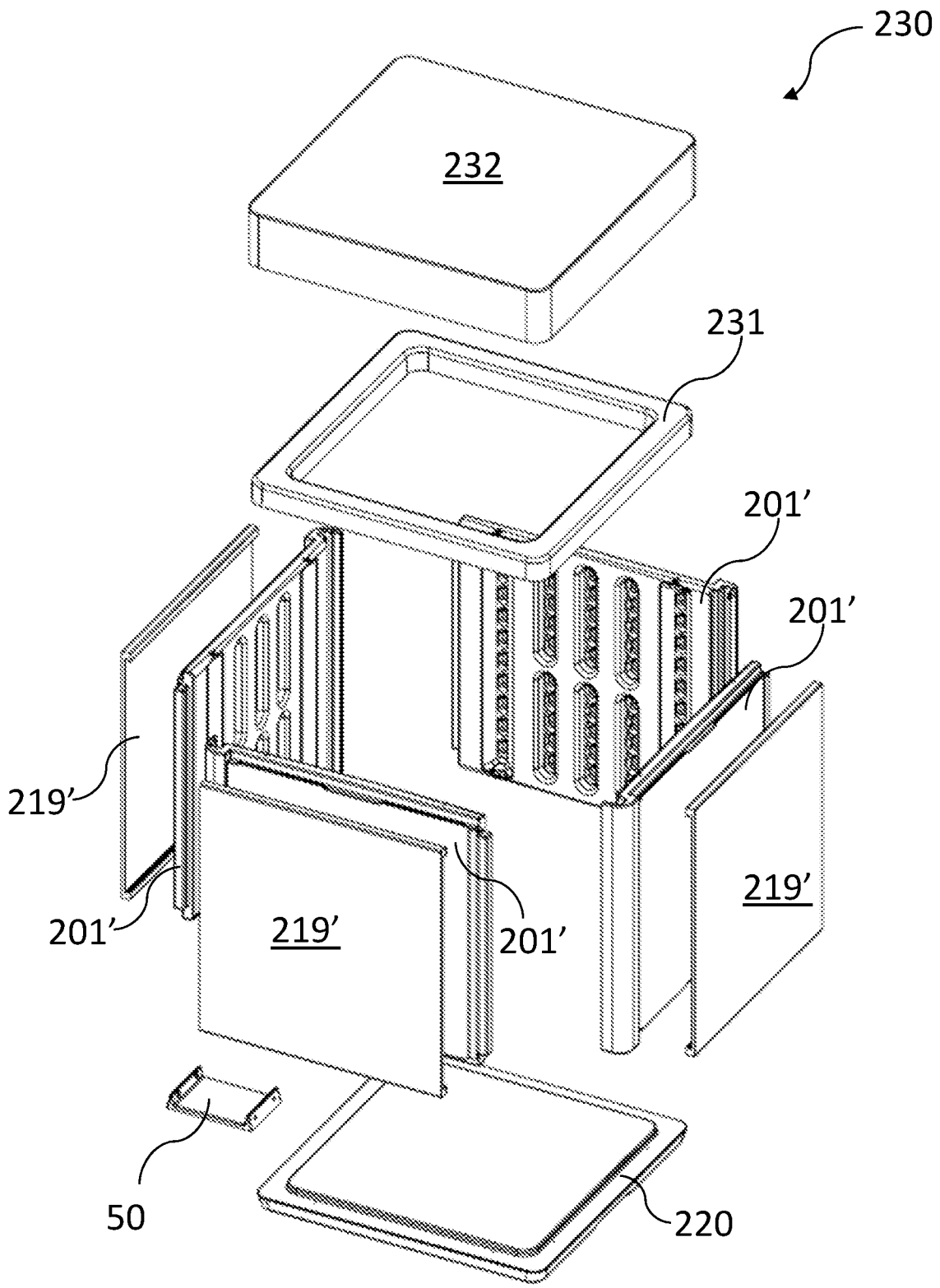
FIG. 26 illustrates an exploded view of one of the flanking containers.

FIG. 26 illustrates an exploded view of one of the flanking containers 230. Though only one container 230 is illustrated, it is to be understood that the following discussion applies to any containers 230 incorporated into the steps 250. Like the upper and lower frames 20', 25', the container 230 is made out of structural panels 201' that receive decorative panels 219', in addition to a bottom panel 220, a lid frame 231, and a lid 232. The container 230 may also include a connection mechanism 50 for connecting the container 230 to the lower frame 20'. The connection mechanism may include a projection on a first end, and a projection on a second end, as described in more detail below with reference to FIG. 35. The projection on the first end of the connection mechanism 50 may engage a recess on an underside of the bottom panel 220 of the container 230 and the projection on the second end of the connection mechanism 50 may engage a corresponding recess on an underside of the bottom panel 220 of the lower frame 20'. In this way, the container 230 may be arranged securely next to the upper and lower frames 25', 20'.

When assembled (as in FIG. 24), the container 230 may be used for storage, such as for spa accessories and/or chemical bottles. Alternatively, the containers 230 may be used as planter boxes or for holding other decorative items.

Figure 27:
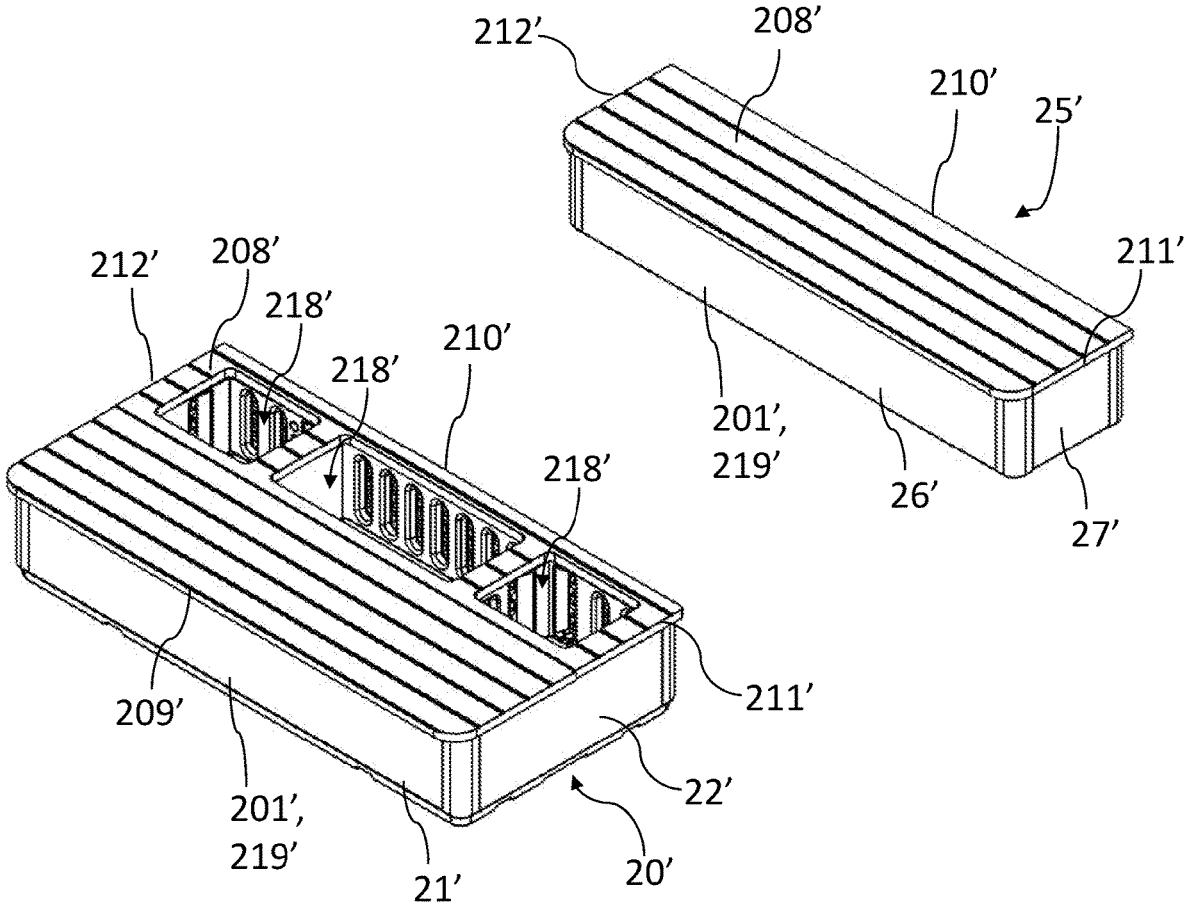
FIG. 27 illustrates a partially exploded view of the lower frame and upper frame of FIG. 24.
Figure 28:
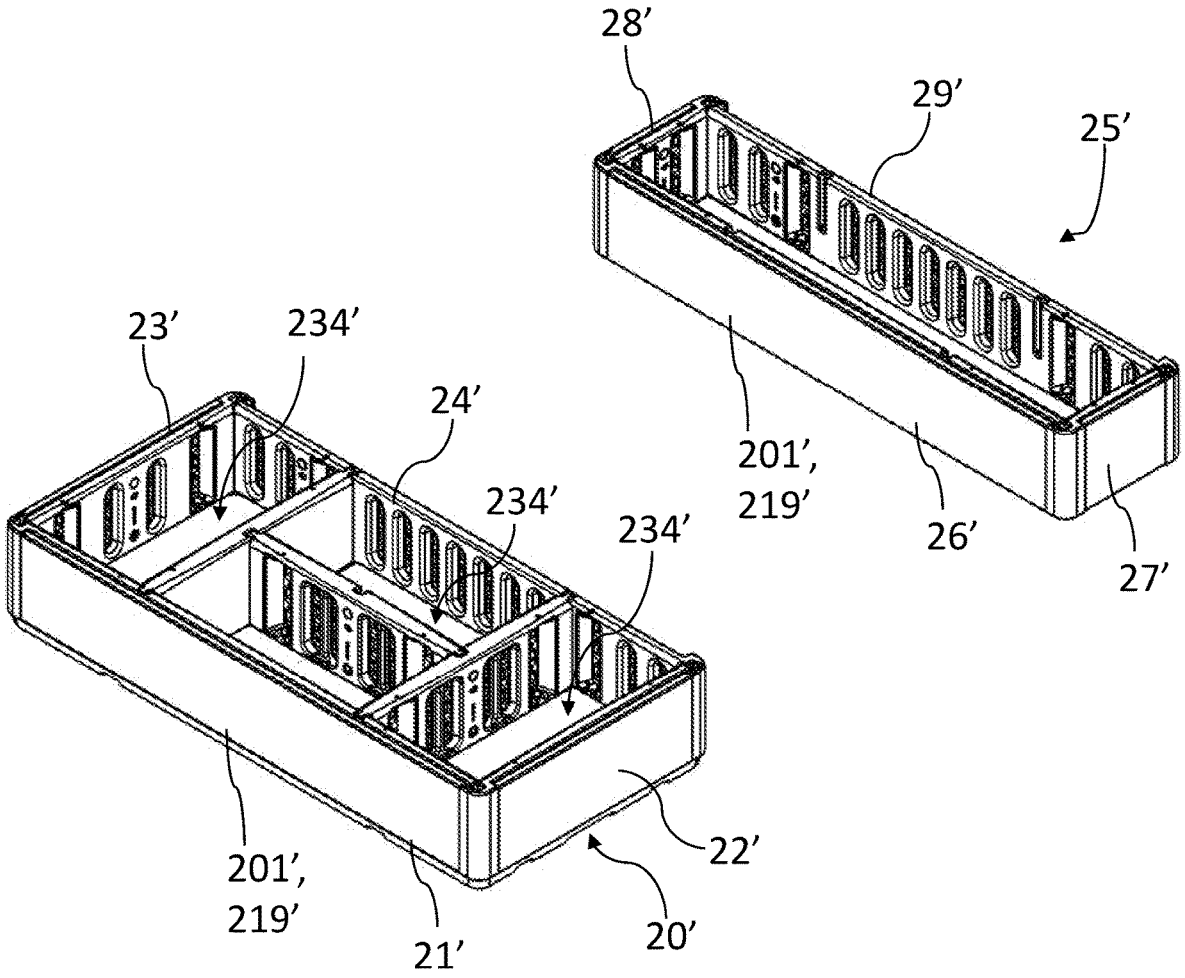
FIG. 28 illustrates the lower frame and upper frame of FIG. 27 with the step platforms removed such that the interior of the steps is visible.
Figure 29:
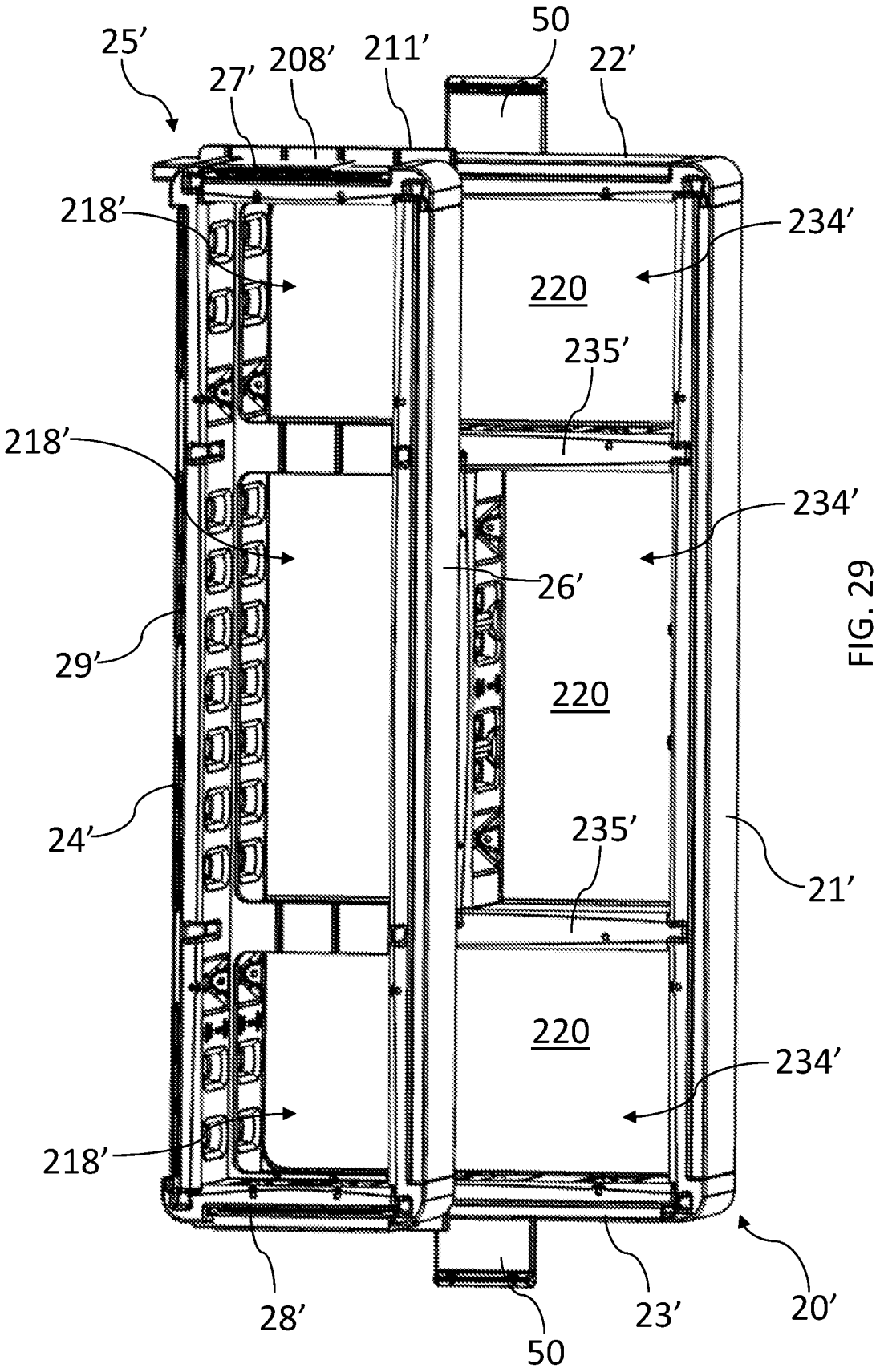
FIG. 29 illustrates a plan view of the steps of FIG. 24 where the step platforms have been removed such that the interior of the steps is visible.
Figure 30:
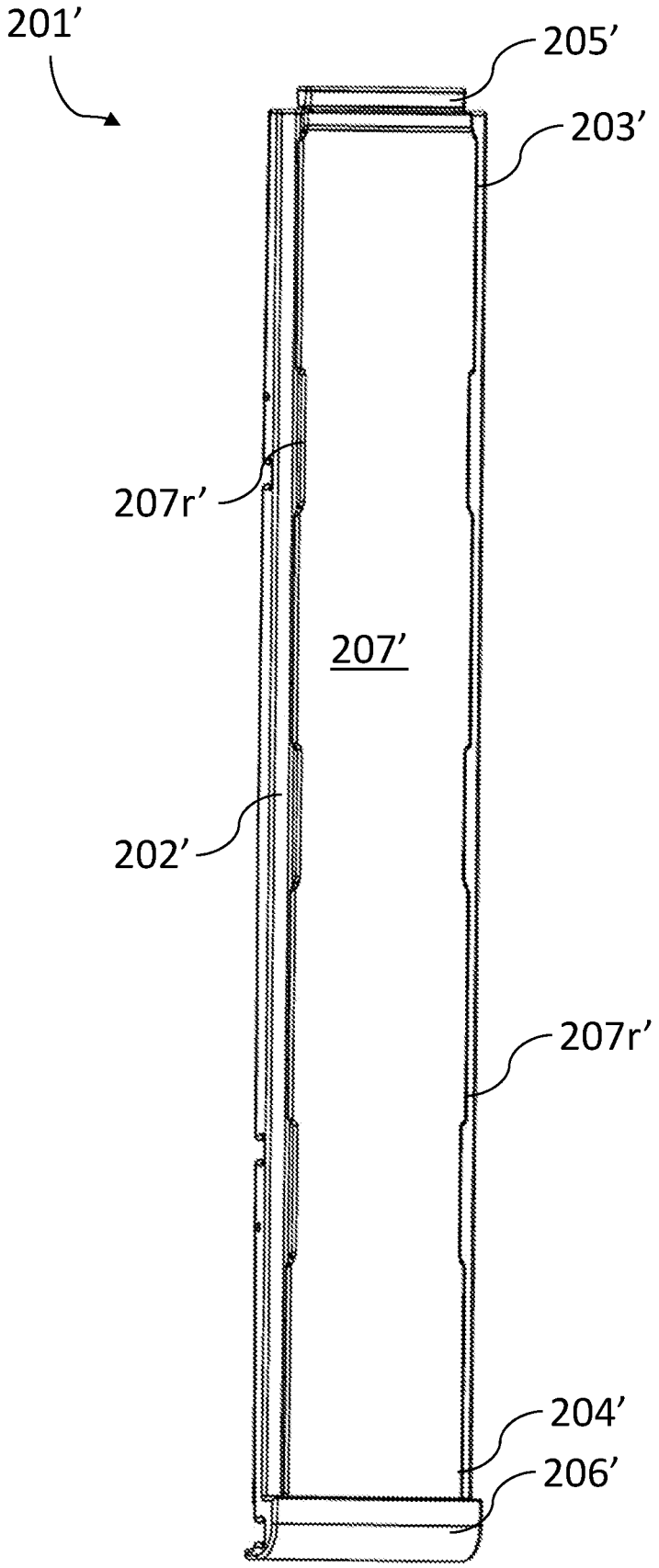
FIGS. 30-33 illustrate similar views of FIGS. 15-16 for the structural panel(s) of the steps of FIG. 24.
Figure 31:
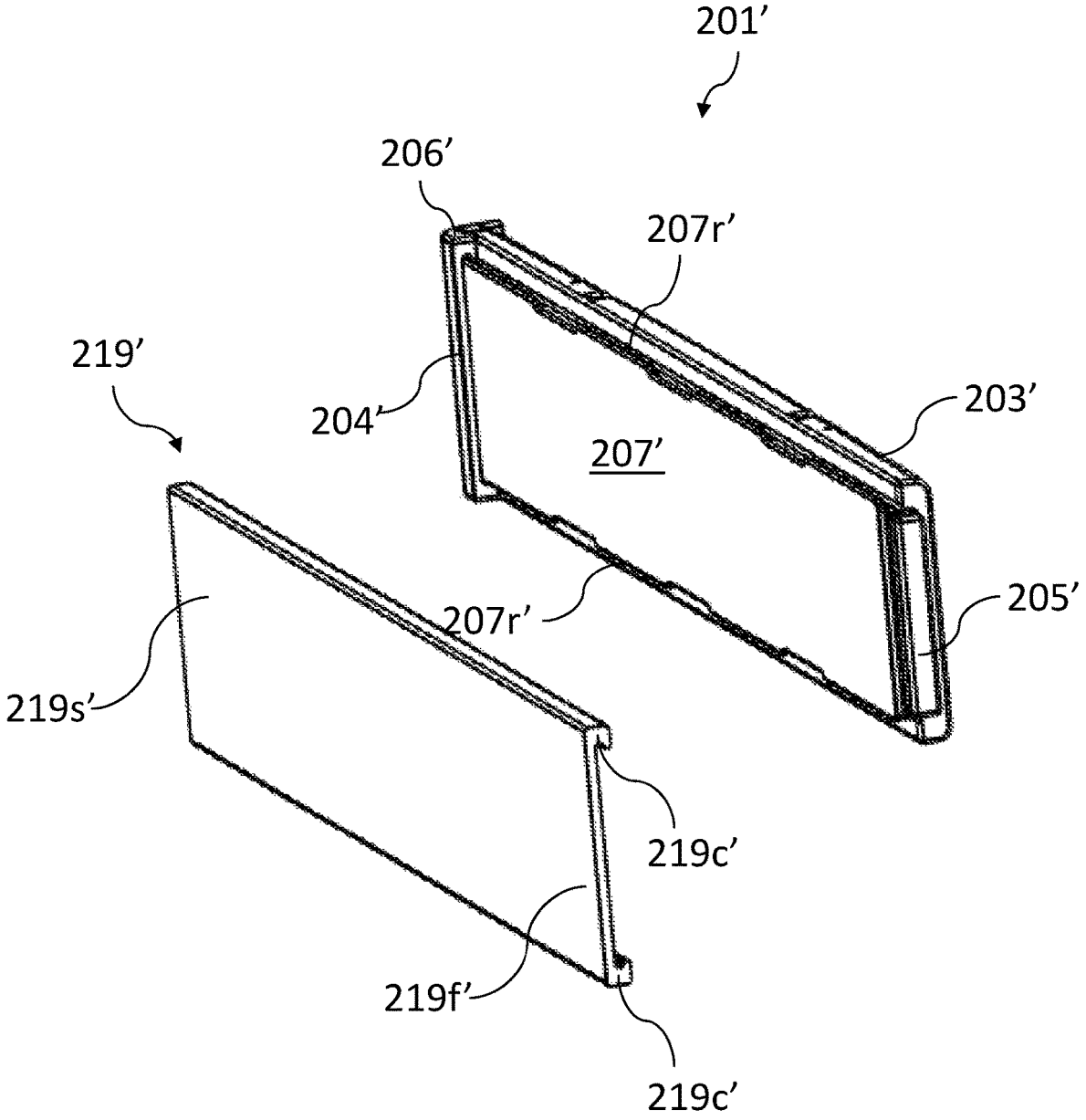

FIG. 27 illustrates a partially exploded view of the lower frame 20' and upper frame 25' and FIGS. 28-29 illustrate view of the lower frame 20' and upper frame 25' with the step platforms 208 removed such that the interior of the lower frame 20' and upper frame 25' is visible. Clearly illustrated are the interior panels 235', which may define the one or more hollow spaces or compartments 234' in the lower frame 20'.

The lower frame 20' has a front edge or face 21', a first side edge or face 22', a second opposing side edge or face 23', and a back edge or face 24'. Similarly, the upper frame 25' has a front edge or face 26', a first side edge or face 27', a second opposing side edge or face 29', and a back edge or face 29'.

The connection mechanisms 50 are illustrated having engaged a recess (not illustrated) in the bottom panel 220. Accordingly, an opposing end of the connection mechanism 50 is free to engage with a recess defined in the bottom panel 220 of either (i) a lower frame of another set of steps, or (ii) a container 230. Though not illustrated, a third connection mechanism 50 may be engaged with a recess (not illustrated) in the bottom panel 220 disposed near the back edge 24' of the lower frame 20', such that an opposing end of the third connection mechanism 50' may engage with a recess on an underside of a spa, such that the steps 250' are securely connected to the spa.

FIGS. 30-33 illustrate various views of a structural panel 201' of the steps 250 of FIG. 24. Each of the structural panels 201' may have the same or substantially the same configuration, with a length and/or width of each structural panel 201' being determined by where in the steps 250 the structural panel 201' is incorporated. For example, the side structural panels 201' will be shorter than the front and back structural panels 201', and the structural panels 201' for the containers 230 are substantially square rather than rectangular.

Each structural panel 201' includes a body 202' with a first end 203' and an opposing second end 204'. Extending from the first end 203' is a tenon 205', which may be the same shape as the tenon 15 of FIG. 6. Incorporated in the second 204' is a mortice 206', which may be the same shape as the mortices 18 of FIGS. 4A-4B. As with the tenons 15 and mortices 18, a tenon 205' of a first structural panel 201' may be slidably received by a mortice 206' of a second, adjacent structural panel 201'.

Extending from the body 202' may be a face plate 207' forming rails **207*r'* to slidably receive the decorative panel 219'. The face plate 207' may be the front of the structural panel 201'. In some embodiments, the rails 207*r'* extend as narrow channels from the body 202'. Specifically, the decorative panels 219' may each include clamps or curves 219*c'* that slide onto the rails 207*r'* (see FIG. 32B). The decorative panels 219' may have a first end 219*f* and an opposing second end 219*s'***.

Figure 32A:
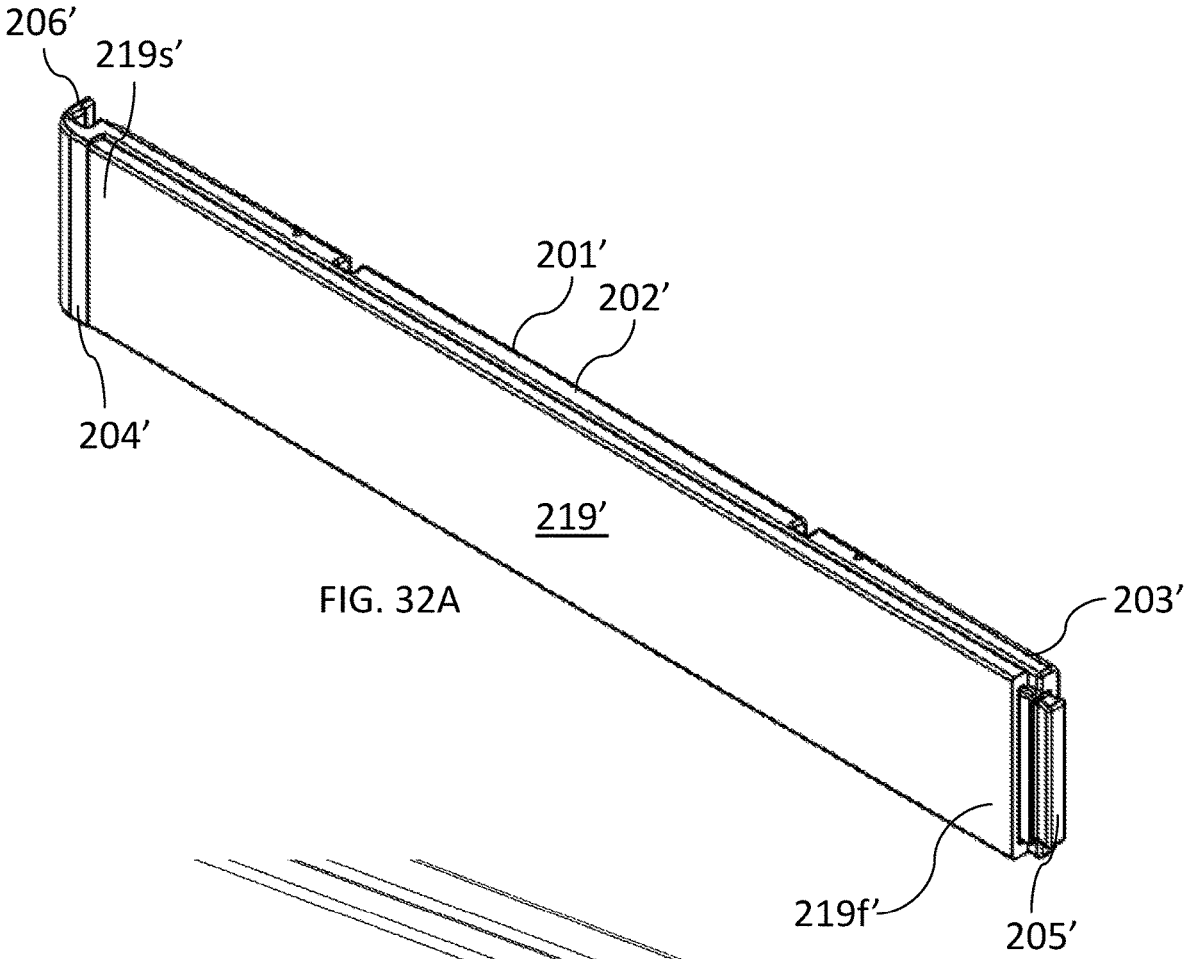
Figure 32B:
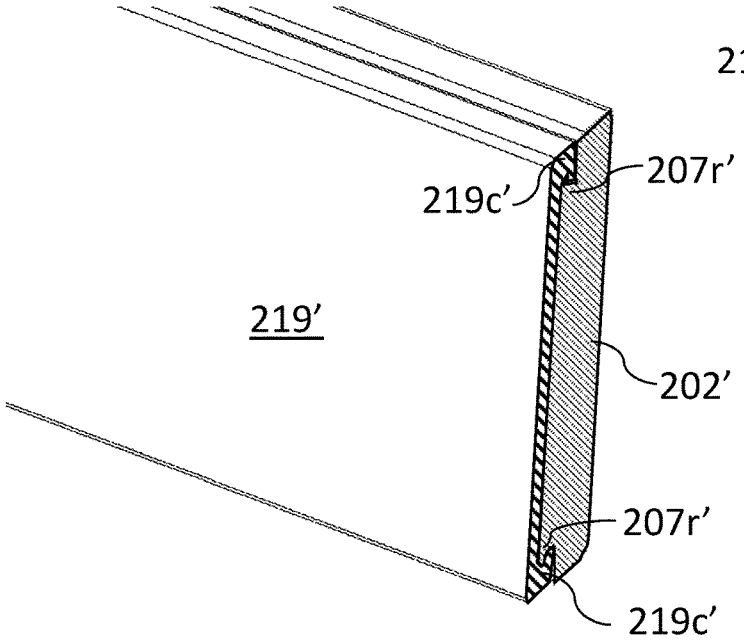
Figure 33:
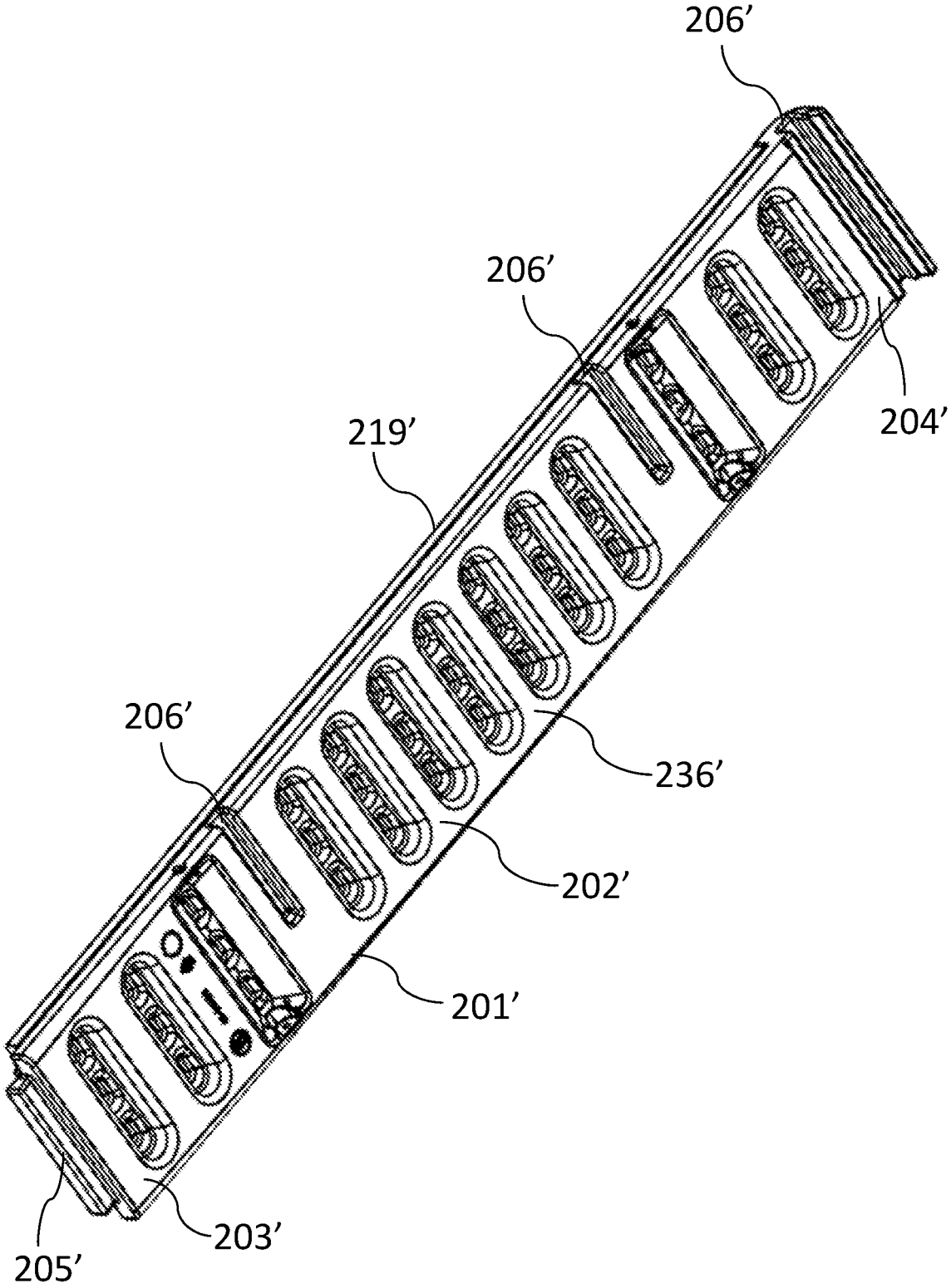

When the decorative panel 219' is slid onto the rails **207*r'* and is in position over the structural panel 201', the second end 219*s'* of the decorative panel 219' may abut the second end 204' of the structural panel 201', and the first end 219*f'* of the decorative panel 219' may abut the first end 203' of the structural panel 201' (see FIG. 32A). The first end 219*f'* of the decorative panel 219' may be "free", in that the decorative panel 219' may be slid off of the rails 207*r'*, until a mortice 206' of a second adjacent structural panel 201' is connected to the tenon 205' of the structural panel 201' carrying the decorative panel 219'. In this way, the decorative panel 219' may be locked onto the structural panel 201'. By disconnecting the two structural panels 201' (e.g., by disengaging the tenon 205' from the mortice 206'), the decorative panel 219' may be removed and replaced with a different decorative panel 219'**.

A back 236' of the structural panels 201' may define additionally mortices 206', which may be for engaging the internal panels 235'. Additionally, similar to the panels 10 of FIGS. 1-9, the back 236' of the structural panels 201' may include a plurality of depressions, which may make the formed structural panels 201' lighter and easier to maneuver for a user. The structural panels 201' may be formed in a blow-molding process.

Figure 34:
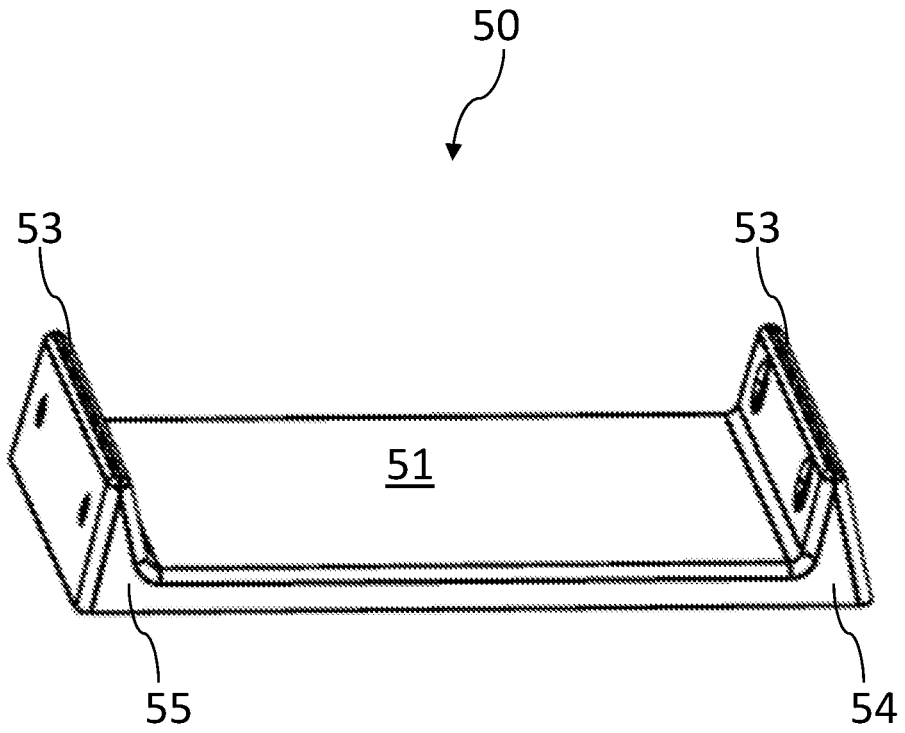
FIG. 34 illustrates one embodiment of a connection mechanism for connecting any of the steps of FIGS. 1, 10, and 24.

FIG. 34 illustrates one embodiment of a connection mechanism 50 for connecting any of the steps of the various configurations shown in FIGS. 1, 10, and 24. The connection mechanism can also be used to connect steps of other configurations to a spa. The connection mechanism 50 includes a body 51 having a first projection 52 at a first end 54, and a second projection 53 at a second opposing end 55. The projections 52, 53 may be shaped and sized to fit within recesses defined in a bottom panel 220 of a lower frame 20, 20' or a bottom panel 220 of a container 230. Additionally, the projections 52, 53 may be shaped and sized to fit within recesses defined in an underside of a spa, thereby connecting steps 100, 200, 250 and/or containers 230 to a the underside of the spa.

The connector 50 can make it simple to remove the steps from the spa, by simply lifting the steps upward, thereby disengaging a projection from the bottom of the steps. Spa steps may be required to be moved away from the spa fairly regularly to access the spa for maintenance. The spa steps can be firmly attached to the spa by simply placing the steps again over the connection mechanism 50, engaging a projection of the connection mechanism 50 with the recesses defined in the bottom of the step(s).

Figure 35:
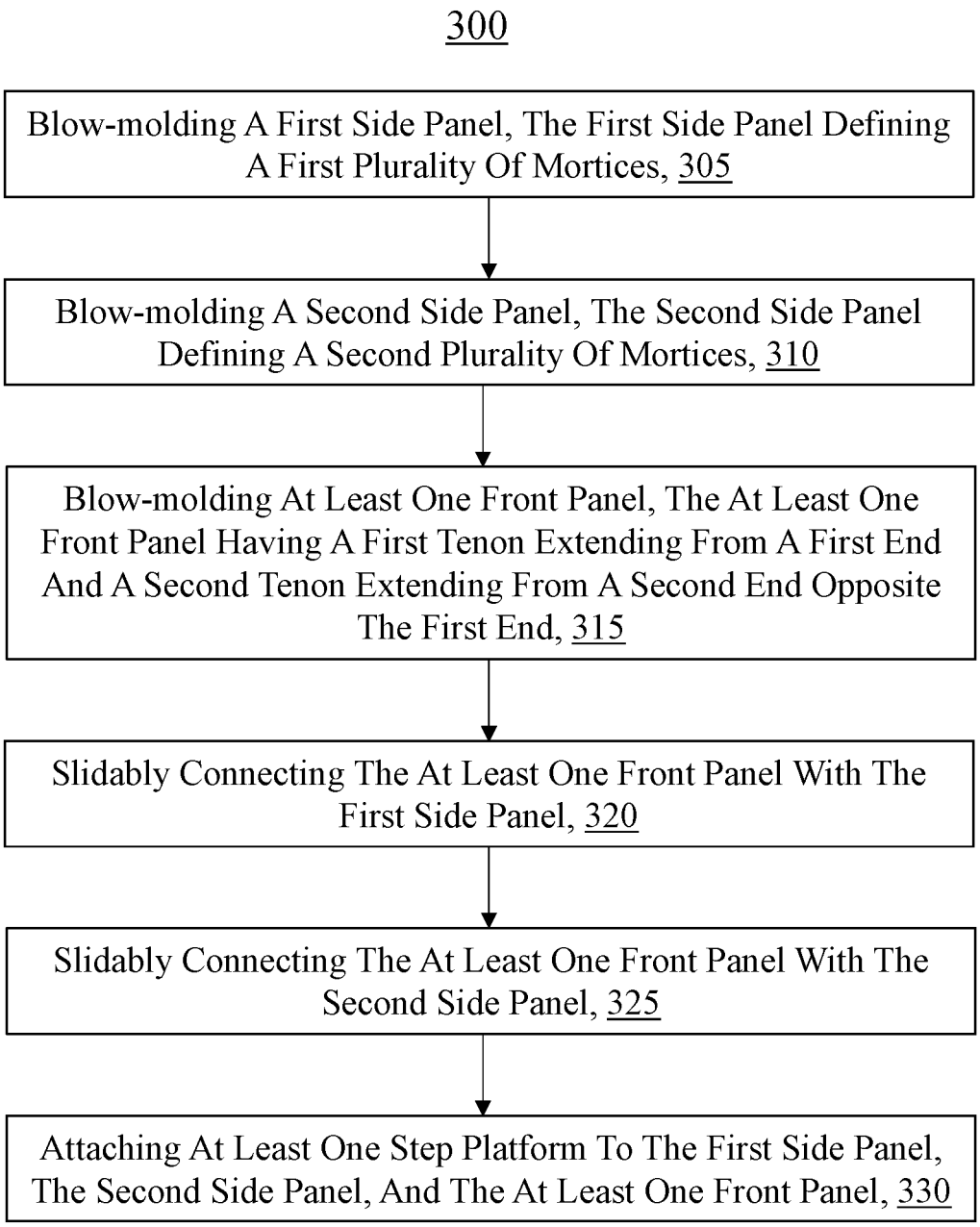
FIGS. 35-37 illustrate flowcharts of example methods, according to the present disclosure.
Figure 36:
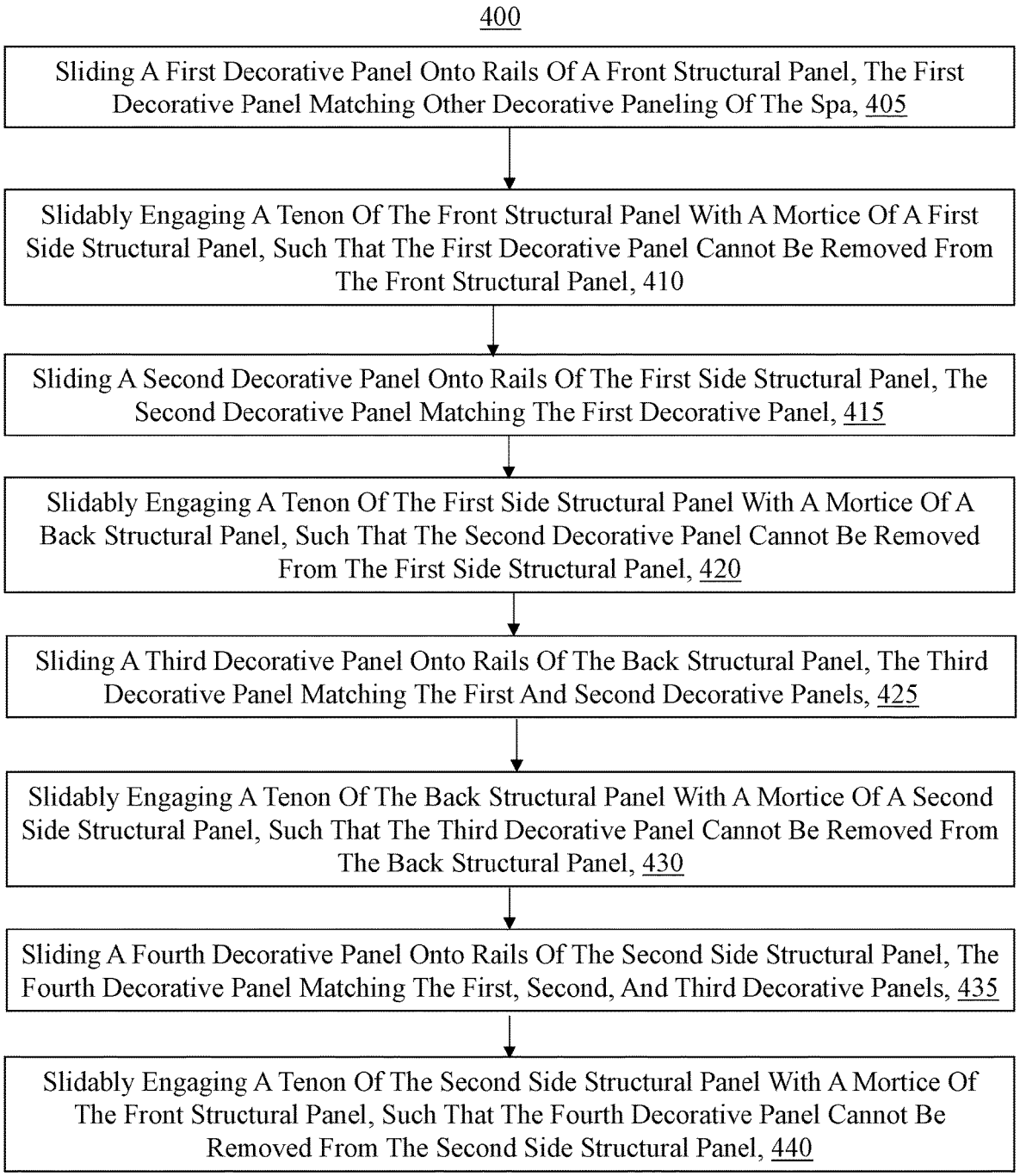
Figure 37:
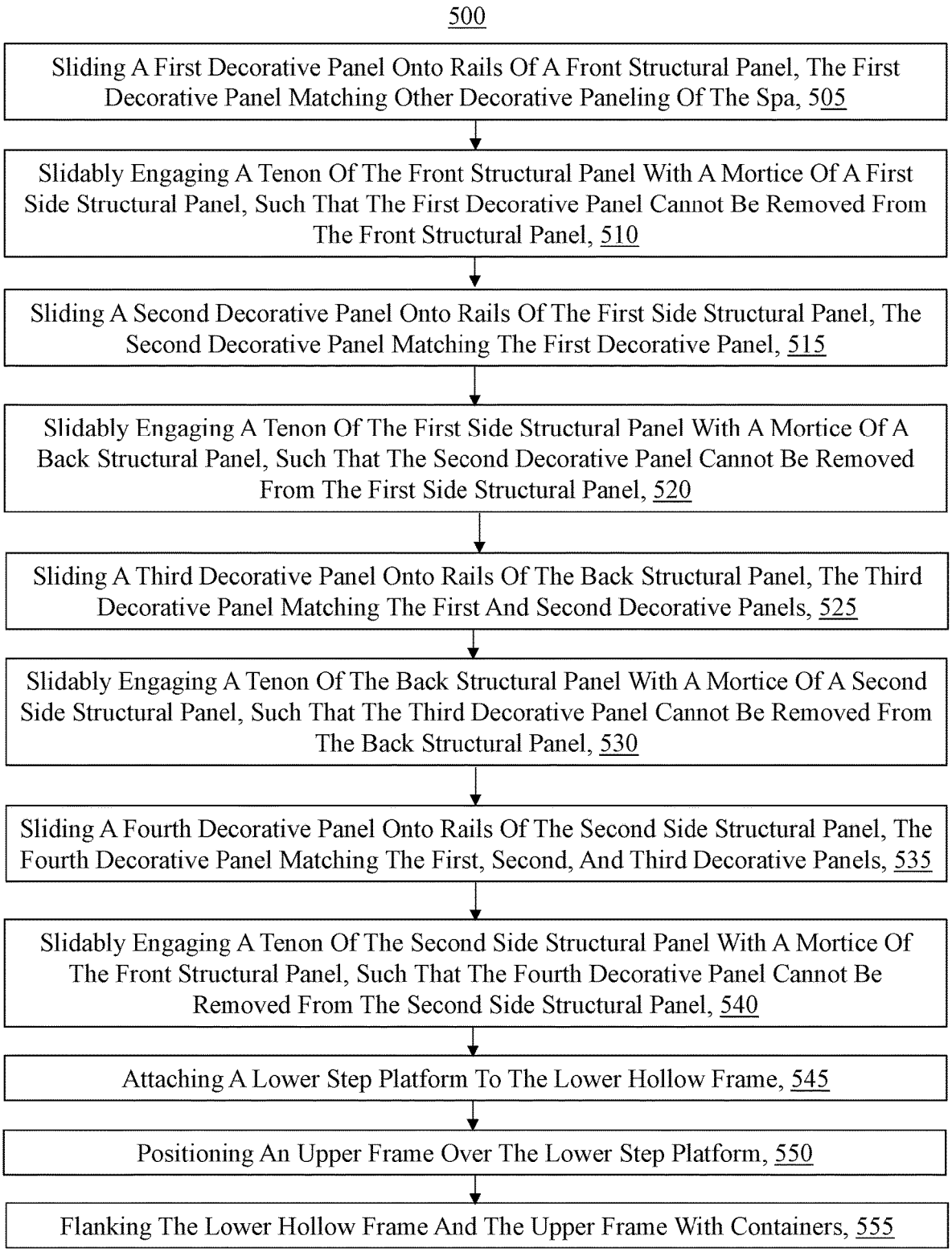

FIGS. 35-37 illustrate flowcharts of various methods, according to the present disclosure. FIG. 35 illustrates a flowchart for a method 300 of forming steps for a spa, such as the steps 100 of FIGS. 1-9. The method 300 may include blow-molding a first side panel, the first side panel defining a first plurality of mortices, at 305. The method 300 may also include blow-molding a second side panel, the second side panel defining a second plurality of mortices, at 310. The method 300 may further include blow-molding at least one front panel, the at least one front panel having a first tenon extending from a first end and a second tenon extending from a second end opposite the first end, at 315. Still further, the method 300 may include slidably connecting the at least one front panel with the first side panel, at 320, and slidably connecting the at least one front panel with the second side panel, at 325. Additionally, the method 300 may include attaching at least one step platform to the first side panel, the second side panel, and the at least one front panel, at 330.

The panels may be the panel 10 of FIGS. 1-9. As such, slidably connecting the front panel with the side panels may include sliding a first tenon extending from a first end of the front panel into a mortice defined in a corresponding end of the first side panel and sliding a second tenon extending from a second opposing end of the front panel into a mortice defined in a corresponding end of the second side panel.

FIG. 36 illustrates a flowchart for a method 400 of assembling steps for a spa, such as the steps 200 or 250 of FIGS. 10-33. The method 400 may include sliding a first decorative panel onto rails of a front structural panel, the first decorative panel matching other decorative paneling of the spa, at 405; slidably engaging a tenon of the front structural panel with a mortice of a first side structural panel, such that the first decorative panel cannot be removed from the front structural panel, at 410; sliding a second decorative panel onto rails of the first side structural panel, the second decorative panel matching the first decorative panel, at 415; and slidably engaging a tenon of the first side structural panel with a mortice of a back structural panel, such that the second decorative panel cannot be removed from the first side structural panel, at 420.

The method 400 may further include sliding a third decorative panel onto rails of the back structural panel, the third decorative panel matching the first and second decorative panels, at 425; slidably engaging a tenon of the back structural panel with a mortice of a second side structural panel, such that the third decorative panel cannot be removed from the back structural panel, at 430; sliding a fourth decorative panel onto rails of the second side structural panel, the fourth decorative panel matching the first, second, and third decorative panels, at 435; and slidably engaging a tenon of the second side structural panel with a mortice of the front structural panel, such that the fourth decorative panel cannot be removed from the second side structural panel, at 440.

The structural panels (e.g., front structural panel, first side structural panel, second side structural panel, the back structural panel, etc.) may be the structural panels 201 of FIGS. 10-23 or structural panels 201' of FIGS. 24-33. Similarly, the decorative panels may be the decorative panels 219 of FIGS. 10-23 or decorative panels 219' of FIGS. 24-33.

FIG. 37 illustrates a flowchart for a method 500 of assembling steps for a spa, such as the steps 250 of FIGS. 24-33. The method 500 may include sliding a first decorative panel onto rails of a front structural panel, the first decorative panel matching other decorative paneling of the spa, at 505; slidably engaging a tenon of the front structural panel with a mortice of a first side structural panel, such that the first decorative panel cannot be removed from the front structural panel, at 510; sliding a second decorative panel onto rails of the first side structural panel, the second decorative panel matching the first decorative panel, at 515; and slidably engaging a tenon of the first side structural panel with a mortice of a back structural panel, such that the second decorative panel cannot be removed from the first side structural panel, at 520.

The method 500 may further include sliding a third decorative panel onto rails of the back structural panel, the third decorative panel matching the first and second decorative panels, at 525; slidably engaging a tenon of the back structural panel with a mortice of a second side structural panel, such that the third decorative panel cannot be removed from the back structural panel, at 530; sliding a fourth decorative panel onto rails of the second side structural panel, the fourth decorative panel matching the first, second, and third decorative panels, at 535; and slidably engaging a tenon of the second side structural panel with a mortice of the front structural panel, such that the fourth decorative panel cannot be removed from the second side structural panel, at 540.

The method 500 additionally includes attaching a lower step platform to the lower hollow frame, at 545; positioning an upper frame over the lower step platform, at 550; and flanking the lower hollow frame and the upper frame with containers, at 555.

The structural panels (e.g., front structural panel, first side structural panel, second side structural panel, the back structural panel, etc.) may be the structural panels 201 of FIGS. 10-23 or structural panels 201' of FIGS. 24-33. Similarly, the decorative panels may be the decorative panels 219 of FIGS. 10-23 or decorative panels 219' of FIGS. 24-33. The containers may be containers 230 of FIGS. 24-33.

Embodiments

Embodiment 1: A set of steps for a spa, the steps comprising: a pair of side panels, each side panel comprising:

- a vertical portion defining or including a first plurality of mortices, and
- a horizontal portion integral with the vertical portion and defining or including a second plurality of mortices;
- a lower front panel configured to engage with a front edge of the horizontal portion;
- an upper front panel configured to engage with a front edge of the vertical portion;
- at least one back panel configured to engage with a back edge of the vertical portion;

a lower step platform connectable to the horizontal portion and the lower front panel; and an upper step platform connectable to the vertical portion and the upper front panel.

Embodiment 2: The set of steps of Embodiment 1, wherein the lower step platform is interchangeable with the upper step platform.

Embodiment 3: The set of steps of Embodiment 1, wherein the at least one back panel comprises a first back panel and a second back panel, each configured to engage with the back edge of the vertical portion.

Embodiment 4: The set of steps of Embodiment 3, wherein the second back panel is vertically stacked on the first back panel.

Embodiment 5: The set of steps of Embodiment 3, wherein the upper step platform is connectable to both the upper front panel and the second back panel.

Embodiment 6: The set of steps of Embodiment 1, wherein the lower front panel comprises a first end and a second end opposite the first end, each of the first end and the second end having a tenon for engaging one of the second plurality of mortices of the horizontal portion.

Embodiment 7: The set of steps of Embodiment 1, further comprising an interior lower panel vertically arranged under the upper front panel and substantially aligned with the lower front panel.

Embodiment 8: The set of steps of Embodiment 7, wherein the lower step platform is connectable to both the lower front panel and the interior lower panel.

Embodiment 9: The set of steps of Embodiment 1, wherein the upper step platform is connectable to both the upper front panel and the at least one back panel.

Embodiment 10: The set of steps of Embodiment 1, wherein the upper front panel comprises a first end and a second end opposite the first end, each of the first end and the second end having a tenon for engaging one of the first plurality of mortices of the vertical portion.

Embodiment 11: A set of steps for a spa comprising:

a lower step comprising a step platform and a front panel;

an upper step comprising a step platform and a front panel;

a first side panel connectable to a first side of the lower step and a first side of the upper step;

a second side panel connectable to a second side of the lower step and a second side the upper step, the second side of the lower step and the upper step opposite the first side of the lower step and the upper step; and a back panel connectable to a back edge of the step platform of the upper step, wherein the step platform of the lower step is interchangeable with the step platform of the upper step.

Embodiment 12: The set of steps of Embodiment 11, wherein the first side panel comprises a lower portion connectable to the first side of the lower step and an upper portion connectable to the first side of the upper step.

Embodiment 13: The set of steps of Embodiment 11, wherein the second side panel comprises a lower portion connectable to the second side of the lower step and an upper portion connectable to the second side of the upper step.

Embodiment 14: The set of steps of Embodiment 11, wherein the first side panel is connectable to a first side of the front panel of the lower step.

Embodiment 15: The set of steps of Embodiment 11, wherein the first side panel is connectable to a first side of the front panel of the upper step.

Embodiment 16: A method of forming steps for a spa, the method comprising:

blow-molding a first side panel, the first side panel defining a first plurality of mortices;

blow-molding a second side panel, the second side panel defining a second plurality of mortices;

blow-molding at least one front panel, the at least one front panel having a first tenon extending from a first end and a second tenon extending from a second end opposite the first end, wherein a decorative panel matching other decorative paneling of the spa is attachable to the at least one front panel;

slidably connecting the at least one front panel with the first side panel;

slidably connecting the at least one front panel with the second side panel; and attaching at least one step platform to the first side panel, the second side panel, and the at least one front panel.

Embodiment 17: The method of Embodiment 16, wherein slidably connecting the at least one front panel with the first side panel comprises sliding the first tenon of the at least one front panel into one of the first plurality of mortices.

Embodiment 18: The method of Embodiment 16, wherein slidably connecting the at least one front panel with the second side panel comprises sliding the second tenon of the at least one front panel into one of the second plurality of mortices.

Embodiment 19: The method of Embodiment 16, wherein attaching the at least one step platform to the first side panel, the second side panel, and the at least one front panel comprises fastening the at least one step platform to each of the first side panel, the second side panel, and the at least one front panel using hand tools.

Embodiment 20: The method of Embodiment 16, further comprising blow-molding at least one back panel having a first tenon extending from a first end and a second tenon extending from a second end opposite the first end, the at least one back panel slidably engageable with the first side panel and the second side panel.

Embodiment 21: The method of Embodiment 16, further comprising attaching the steps to the spa.

Embodiment 22: The method of Embodiment 21, wherein attaching the steps to the spa comprises placing the steps over a cleat, such that a bottom recess of the steps engages the cleat.

Embodiment 23: A set of steps for a spa, the steps comprising:

a lower step comprising a base frame, a step platform, and a storage platform defining an access window, the base frame having a plurality of structural panels for slidably receiving a plurality of decorative panels, wherein the plurality of decorative panels match decorative panels of the spa; and an upper step positionable over the storage platform of the lower step, the upper step comprising a base frame and a step platform, the base frame of the upper step having a plurality of structural panels for slidably receiving a plurality of decorative panels, wherein the plurality of decorative panels match the plurality of decorative panels of the lower step and the decorative panels of the spa.

Embodiment 24: The set of steps of Embodiment 23, wherein the plurality of structural panels of the base frame of the lower step comprises a front panel, a back panel opposite the front panel, a first side panel connectable to the front and back panels, and a second side panel connectable to the front and back panels.

Embodiment 25: The set of steps of Embodiment 23, wherein the base frame further comprises a plurality of internal structural panels and a bottom panel, the bottom panel for facilitating a connection of the steps to the spa.

Embodiment 26: The set of steps of Embodiment 25, wherein the bottom panel defines a recess for receiving a cleat, the cleat for connecting the step to the spa.

Embodiment 27: The set of steps of Embodiment 25, wherein the plurality of internal structural panels define a storage cavity, the storage cavity extending from the bottom panel, through the access window, to a bottom surface of the step platform of the upper step.

Embodiment 28: The set of steps of Embodiment 23, wherein the step platform of the upper step is removably attached to the base frame.

Embodiment 29: The set of steps of Embodiment 23, wherein a first edge of the upper step is aligned with a first edge of the lower step and a second edge of the upper step is aligned with a second edge of the access window, the second edge of the upper step spaced a distance from a second edge of the lower step.

Embodiment 30: The set of steps of Embodiment 23, wherein a second edge of the upper step is aligned with a second edge of the lower step and a first edge of the upper step is aligned with a first edge of the access window, the first edge of the upper step spaced a distance from a first edge of the lower step.

Embodiment 31: The set of steps of Embodiment 23, wherein the upper step is positionable over the access window of the storage platform.

Embodiment 32: The set of steps of Embodiment 31, wherein the step platform of the upper step is removably attached to the base frame of the upper step to provide access to the access window of the storage platform.

Embodiment 33: Steps for a spa comprising:

a lower frame comprising a front structural panel, a back structural panel opposite the front structural panel, a first side structural panel, and a second side structural panel opposite the first side structural panel, wherein each structural panel of the lower frame comprises:

a body having a mortice at a first end, a tenon at a second end opposite the first end, and a face plate extending from the body, the face plate for slidably receiving a decorative panel;

a first step platform connectable to the front structural panel, a portion of the first side structural panel, and a portion of the second side structural panel;

a storage platform abutting the step platform and connectable to the back structural panel, a portion of the first side structural panel, and a portion of the second side structural panel;

an upper frame positionable over the storage platform; and a second step platform connectable to the upper frame.

Embodiment 34: The steps of Embodiment 33, wherein the lower frame further comprises a storage cavity defined by the back structural, a first internal panel, a second internal panel opposite the first internal panel, and a third internal panel connected to the first and second internal panels.

Embodiment 35: The steps of Embodiment 34, wherein the storage platform defines a central window for providing access to the storage cavity.

Embodiment 36: The steps of Embodiment 33, wherein the first mortice end of the front structural panel of the lower frame slidably engages the second tenon end of the first side panel and the second tenon end of the front structural panel slidably engages the first mortice end of the second side structural panel.

Embodiment 37: The steps of Embodiment 33, wherein the decorative panel comprises a body having a top clamp edge and a bottom clamp edge for slidably engaging the face plate of the body of the structural panels.

Embodiment 38: A method of assembling steps for a spa, the method comprising:

sliding a first decorative panel onto rails of a front structural panel, the first decorative panel matching other decorative paneling of the spa;

slidably engaging a tenon of the front structural panel with a mortice of a first side structural panel, such that the first decorative panel cannot be removed from the front structural panel;

sliding a second decorative panel onto rails of the first side structural panel, the second decorative panel matching the first decorative panel;

slidably engaging a tenon of the first side structural panel with a mortice of a back structural panel, such that the second decorative panel cannot be removed from the first side structural panel;

sliding a third decorative panel onto rails of the back structural panel, the third decorative panel matching the first and second decorative panels;

slidably engaging a tenon of the back structural panel with a mortice of a second side structural panel, such that the third decorative panel cannot be removed from the back structural panel;

sliding a fourth decorative panel onto rails of the second side structural panel, the fourth decorative panel matching the first, second, and third decorative panels; and slidably engaging a tenon of the second side structural panel with a mortice of the front structural panel, such that the fourth decorative panel cannot be removed from the second side structural panel, wherein the front structural panel, the first side structural panel, the back structural panel, and the second side structural panel form a lower hollow frame.

Embodiment 39: The method of Embodiment 38, further comprising attaching a step platform to a front portion of the lower hollow frame to form a lower step.

Embodiment 40: method of Embodiment 38, further comprising attaching a storage platform to a back portion of the lower hollow frame, the storage platform defining a central window for access to a storage cavity defined within the lower hollow frame.

Embodiment 41: The method of Embodiment 38, further comprising: attaching a storage platform to a back portion of the hollow frame, the storage platform defining a central window for access to a storage cavity defined within the hollow frame; and positioning an upper step on the storage platform in a first position, such that the upper step is positioned over the central window and a first edge of the upper step is aligned with a first edge of the storage platform and a second edge of the upper step is aligned with a second edge of the central window.

Embodiment 42: The method of Embodiment 41, further comprising:

positioning the upper step on the storage panel in a second position different than the first position, such that the upper step is positioned over the central window and the second edge of the upper step is aligned with a second edge of the storage platform and the first edge of the upper step is aligned with a first edge of the central window.

Embodiment 43: The method of Embodiment 38, further comprising: assembling an upper hollow frame;

attaching an upper step platform to the upper hollow frame to form an upper step;

attaching a back platform to a back portion of the lower hollow frame; and positioning the upper hollow frame over the back platform in a first position.

Embodiment 44: The method of Embodiment 43, further comprising moving the upper hollow frame from the first position to a second position over the back platform.

Embodiment 45: A method of assembling steps for a spa, the method comprising:

sliding a first decorative panel onto rails of a front structural panel, the first decorative panel matching other decorative paneling of the spa;

slidably engaging a tenon of the front structural panel with a mortice of a first side structural panel, such that the first decorative panel cannot be removed from the front structural panel;

sliding a second decorative panel onto rails of the first side structural panel, the second decorative panel matching the first decorative panel;

slidably engaging a tenon of the first side structural panel with a mortice of a back structural panel, such that the second decorative panel cannot be removed from the first side structural panel;

sliding a third decorative panel onto rails of the back structural panel, the third decorative panel matching the first and second decorative panels;

slidably engaging a tenon of the back structural panel with a mortice of a second side structural panel, such that the third decorative panel cannot be removed from the back structural panel;

sliding a fourth decorative panel onto rails of the second side structural panel, the fourth decorative panel matching the first, second, and third decorative panels;

slidably engaging a tenon of the second side structural panel with a mortice of the front structural panel, such that the fourth decorative panel cannot be removed from the second side structural panel, wherein the front structural panel, the first side structural panel, the back structural panel, and the second side structural panel form a lower hollow frame;

attaching a lower step platform to the lower hollow frame to form a lower step;

positioning an upper frame over the lower step platform; and flanking the lower hollow frame and the upper frame with a pair of containers.

Embodiment 46: The method of Embodiment 45, further comprising attaching a top step platform to the upper frame to form an upper step.

Embodiment 47: The method of Embodiment 45, wherein the pair of containers are for storing spa accessories.

Embodiment 48: The method of Embodiment 45, wherein the pair of containers each comprise a box and a lid.

Embodiment 49: The method of Embodiment 45, further comprising attaching the steps to the spa using a cleat.

Embodiment 50: The method of Embodiment 49, wherein attaching the steps to the spa using a cleat comprises:

positioning a first portion of the cleat under the spa; and positioning a bottom panel of the lower hollow frame over a second portion of the cleat.

Embodiment 51: The method of Embodiment 50, wherein the cleat comprises a body with a first projection at a first end and a second projection at a second end opposite the first end.

Embodiment 52: Steps for a spa comprising:

a lower hollow frame;

a first platform disposed over the lower hollow frame;

an upper hollow frame disposed over a back portion of the first platform;

a second platform disposed over the upper hollow frame;

a first container arranged on a first side of the lower hollow frame and a first side of the upper hollow frame; and a second container arranged on a second side opposite the first side of the lower hollow frame and a second side opposite the first side of the upper hollow frame.

Embodiment 53: The steps of Embodiment 52, wherein the lower hollow frame comprises:

a front structural panel for receiving a front decorative panel;

a back structural panel for receiving a back decorative panel;

a first side panel connectable to a first end of the front structural panel and a first end of the back structural panel; and a second side panel connectable to a second end of the front structural panel opposite the first end and a second end of the back structural panel opposite the first end, wherein the front and back decorative panels match decorative paneling of the spa.

Embodiment 54: A connection mechanism for removably attaching a spa step to a spa comprising:

a body;

a first projection at a first end of the body; and a second projection at a second end of the body, where the first projection is for engaging an underside of a spa and the second projection is for engaging an underside of steps for the spa.

Additional Terms and Definitions

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to a particular water-containing vessel (e.g., a spa); however, other vessels (e.g., pools, tubs, swim spas, etc.) are also contemplated. A spa is also known in the industry as a hot tub and is generally formed of a concave shell to receive and contain water. Structures, such as a jet, can extend through the concave shell to move water from a surface outside the spa to a surface inside the spa or shell. Surfaces inside the shell are referred to as more "proximal" while surfaces that extend through the shell are referred to as "distal." A proximal side of a jet faces the spa shell where the user relaxes, and the jet can provide hydrotherapy to the user in the spa.

In one embodiment, the terms "about" and "approximately" refer to numerical parameters within 10% of the indicated range. The terms "a," "an," "the," and similar referents used in the context of describing the embodiments of the present disclosure (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments are described herein, including the best mode known to the author(s) of this disclosure for carrying out the embodiments disclosed herein. Of course, variations on these described embodiments will become apparent to those of ordinary skill in the art upon reading the foregoing description. The author(s) expects skilled artisans to employ such variations as appropriate, and the author(s) intends for the embodiments of the present disclosure to be practiced otherwise than specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of this disclosure so claimed are inherently or expressly described and enabled herein.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A set of steps for a spa, the steps comprising:

a pair of side panels, each side panel comprising:

a vertical portion defining or including a first plurality of mortices, and a horizontal portion integral with the vertical portion and defining or including a second plurality of mortices;

a lower front panel configured to engage with a front edge of the horizontal portion, the lower front panel comprising a slot for slidably receiving a lower front decorative panel;

an upper front panel configured to engage with a front edge of the vertical portion, the upper front panel comprising a slot for slidably receiving an upper front decorative panel, the lower front decorative panel and the upper front decorative panel matching a decorative panel of the spa;

at least one back panel configured to engage with a back edge of the vertical portion;

a lower step platform connectable to the horizontal portion and the lower front panel; and an upper step platform connectable to the vertical portion and the upper front panel.

2. The set of steps of claim 1, wherein the pair of side panels prevents the lower front decorative panel and upper front decorative panel from being slidably removed from the lower front panel slot and the upper front panel slot.

3. The set of steps of claim 2, further comprising a cleat to removably attach the set of steps to a spa, the cleat comprising:

a body;

a first projection at a first end of the body; and a second projection at a second end of the body, where the first projection is for engaging an underside of a spa and the second projection is for engaging an underside of the set of steps to the spa.

4. The set of steps of claim 2, wherein the upper step platform is connectable to both the upper front panel and a second back panel.

5. The set of steps of claim 1, wherein the lower front panel comprises a first end and a second end opposite the first end, each of the first end and the second end having a tenon for engaging one of the second plurality of mortices of the horizontal portion.

6. The set of steps of claim 1, further comprising an interior lower panel vertically arranged under the upper front panel and substantially aligned with the lower front panel.

7. The set of steps of claim 6, wherein the lower step platform is connectable to both the lower front panel and the interior lower panel.

8. The set of steps of claim 1, wherein the upper step platform is connectable to both the upper front panel and the at least one back panel.

9. The set of steps of claim 1, wherein the upper front panel comprises a first end and a second end opposite the first end, each of the first end and the second end having a tenon for engaging one of the first plurality of mortices of the vertical portion.

10. A set of steps for a spa comprising:

a lower step comprising a step platform and a front panel, the front panel comprising a slot for slidably receiving a lower front decorative panel;

an upper step comprising a step platform and a front panel, the front panel comprising a slot for slidably receiving an upper front decorative panel, each of the lower front decorative panel and the upper front decorative panel matching a decorative panel of the spa;

a first side panel connectable to a first side of the lower step and a first side of the upper step, the first side panel connectable without visible fasteners;

a second side panel connectable to a second side of the lower step and a second side the upper step, the second side of the lower step and the upper step opposite the first side of the lower step and the upper step, the second side panel connectable without visible fasteners; and a back panel connectable to a back edge of the step platform of the upper step, wherein the step platform of the lower step is interchangeable with the step platform of the upper step.

11. The set of steps of claim 10, wherein the first side panel comprises a lower portion connectable to the first side of the lower step and an upper portion connectable to the first side of the upper step.

12. The set of steps of claim 10, wherein the second side panel comprises a lower portion connectable to the second side of the lower step and an upper portion connectable to the second side of the upper step.

13. The set of steps of claim 10, wherein the first side panel is connectable to a first side of the front panel of the lower step.

14. The set of steps of claim 10, wherein the first side panel is connectable to a first side of the front panel of the upper step.

15. A set of steps for a spa, the steps comprising:

a pair of side panels, each side panel comprising:

a vertical portion defining or including a first plurality of mortices, and a horizontal portion integral with the vertical portion and defining or including a second plurality of mortices;

a lower front panel configured to engage with a front edge of the horizontal portion;

an upper front panel configured to engage with a front edge of the vertical portion;

at least one back panel configured to engage with a back edge of the vertical portion;

a lower step platform connectable to the horizontal portion and the lower front panel;

an upper step platform connectable to the vertical portion and the upper front panel; and an interior lower panel vertically arranged under the upper front panel and substantially aligned with the lower front panel.

* * * * *